US005676087A

United States Patent [19]

Baker

[11] Patent Number: 5,676,087

[45] Date of Patent: Oct. 14, 1997

[54] WATERCRAFT HULL

[76] Inventor: Elbert H. Baker, 21 Baldwin St., Hudson, Ohio 44236

[21] Appl. No.: 763,188

[22] Filed: Dec. 10, 1996

Related U.S. Application Data

[63] Continuation-in-part of Ser. No. 679,856, Jul. 15, 1996, Pat. No. 5,619,944.

[51] Int. Cl.[6] ..... B63B 1/00

[52] U.S. Cl. ..... 114/283; 114/292; 114/61

[58] Field of Search ..... 114/271, 283, 114/288–291, 56, 61, 292; D21/300, 310–312, 317

[56] References Cited

U.S. PATENT DOCUMENTS

| | | | |
|---|---|---|---|
| Re. 33,359 | 10/1990 | Lang | 114/283 |
| 966,000 | 8/1910 | Folk | 114/283 |
| 2,366,035 | 12/1944 | Leone | 114/271 |
| 2,369,129 | 2/1945 | Bell et al. | 114/283 |

FOREIGN PATENT DOCUMENTS

| | | | |
|---|---|---|---|
| WO 90/01000 | 2/1990 | WIPO | 114/280 |

*Primary Examiner*—Edwin L. Swinehart

*Attorney, Agent, or Firm*—R. Lawrence Sahr

[57] ABSTRACT

A dynamic mode shallow draft ski-toon boat featuring a multi-hulled bottom with water skis mounted thereto is disclosed and described, the ski-toon boat being capable of planing at lower velocities and utilizing substantially less engine power in comparison to conventional hulled boats.

20 Claims, 11 Drawing Sheets

WATERCRAFT HULL

This application is a Continuation-In-Part of application Ser. No. 08/679,856 filed Jul. 15, 1996, now U.S. Pat. No. 5,619,944, issued Apr. 15, 1997.

BACKGROUND

1. Field of the Invention

The invention relates generally to watercraft, specifically to watercraft hulls and more specifically to flat bottom watercraft hulls.

2. Background of the Invention

Conventional recreational and commercial watercraft, for the most part, incorporate hulls which have V-shaped bottoms, with the V-shape, at its lowest point, forming a keel. The V-shape is thought to enable the boat, as speed is increased, to be pushed upwardly out of the water, as the water traversing against the boat's bow is forced sideways and downwardly at a vector to the outer shape of the hull. Such designs have worked well for years. The force of the water being pushed sideways and downwardly by the forward movement of the boat also provides a substantial stability to the boat, especially in turns and as the boat is steered into oncoming waves and the wakes from other boats.

One detriment to such hull designs is that the draft of the boat tends to be relatively deep in relation to the length and beam of the boat, thus requiring sufficient depth of water to accommodate that draft. Another detriment to such hull designs is that they require a relatively large amount of force (and horsepower) to propel such a boat forward at a sufficient speed to stabilize the boat, i.e., to force the water sideways and downwardly as the boat travels generally horizontally through the water.

With V-shaped hull designs, initially, as velocity begins to increase from zero, the bow of the boat acts much like a plow, digging into and through the surface of the water. This creates what is known as a "bow wave". As velocity increases more, the bow tends to be forced upwardly by the sideways and downward force being applied to the water by the curvature of the V-shape of the hull being forced horizontally forward and up over the bow wave.

Finally, when sufficient velocity is approached then reached, the apex of the force on the V-shaped hull travels aftwardly along the hull, forcing the boat more upwardly to an increasing degree until a point is reached at which the bow, now out of the water, tends, by force of gravity, to descend toward the water, pivoting on the apex of the force against the sides and bottom of the V-shaped hull. This pivoting serves to raise the stern of the boat as the bow descends until the whole boat is lifted upwardly onto what is known as a plane. At this point, because there is relatively less water contacting the hull, drag from that water is reduced and the boat is correspondingly able to go significantly faster given the same amount of force propelling the boat forward.

Of course, as might be anticipated, the hydraulic force of the water against the V-shaped hull is substantial, thus an equally substantial counteracting force, provided by the engine of the boat, is required to get the boat up on a plane and to maintain it there. The ultimate speed of the boat, when up on a plane, depends on the specific design of the V-shaped hull, the weight (and weight distribution) of the boat, and the available power, i.e., the size of the engine and the size and pitch of the propeller which is driven by the engine.

However, in all cases, the forward movement of the boat, at any speed, whether up on plane or not, is counteracted by both sideways and downward vectors of force produced by the relative hydraulic movement of the water against the hull.

The amount of fuel needed to power a boat at a given velocity is in direct proportion to the overall degree of each of the forces needed to be overcome to move that boat forward over a given distance. The greater those forces, the greater will be the amount of fuel consumed. Thus as a general proposition, if fuel economy is a concern, hull designs are desirable which tend to reduce the overall amount of opposing forces directed against the hull during forward movement of the boat. One approach to this is the use of relatively flat bottom hulls wherein there is less counteracting hydraulic force imposed against the hull as the boat moves forward. A flat hull is more readily pushed directly up over the bow wave to a position substantially on top of the water, creating less displacement of water by the hull in the dynamic mode as distinguished from the static mode. In other words, dynamic displacement of water is significantly less with a flat bottom boat than with a V-shaped bottom. On the other hand, static displacement, when the boat is at rest, is substantially the same for a flat bottom or a V-bottom boat, given equivalent boat weights and hull surface contact with the water.

Watercraft or boats with flat bottom hulls have been known for years. Small fishing boats have been manufactured for years, the concept seemingly to produce a boat with a relatively shallow draft to enable sports fishermen to get into shallow waters along shorelines, into shallow, swampy areas, and into lakes, ponds and streams which are not sufficiently deep to accommodate the draft of conventional V-bottom boats. Some of these boats include hull designs which incorporate pontoons or sponsons for lateral stability and floatation, better enabling fishermen to stand near the sides of the boats without upsetting those boats.

Such designs have evolved into what are popularly called "bass boats". Bass boat hulls are relatively narrow, in relation to length, with generally flat bottoms and relatively shallow V-shapes, if any. The draft of these boats is relatively shallow in comparison to V-shaped hulls. Once up on a plane, the vector force of the water is mostly downwardly, forcing these boats to rise up out of the water to a greater degree at relatively slower speeds, thus ultimate velocity can be greater, and relatively less engine power may be required to reach a given velocity.

The down side is that, because bass boats are relatively narrow beamed and because there is relatively little sideways or lateral force being exerted against the hull of a bass boat, there is correspondingly less lateral stability, and, due to a relatively narrow beam, such boats tend to be more easily tipped over by laterally moving waves and the wakes of other boats. Also, such boats do not steer as easily or as precisely as those with distinct, V-shaped hulls, seemingly because bass boats incur relatively less opposing sideways forces, those forces which tend to hold a boat to a straight forward movement which can be precisely altered by a rudder device at the stern. Therefore, when steered to turn, bass boats tend to skid laterally sideways more readily, thus making turning a much less precise and controllable skidding action, rather than the positive, precisely controllable action of V-shaped hulls. Bass boat designs rarely incorporate sponsons, thus, for the sake of safety, it is almost necessary to slow some high-powered bass boats down, before turning, to both effect a more precise turn and to prevent the boat from flipping over.

Pontoon boats have, likewise, been known for years. The hull designs of conventional pontoon boats incorporate two, three, four or more pontoons, generally arranged such that each pontoon is generally parallel to each other and all run from bow to stern of the boat. A platform of some type or other is usually mounted horizontally to the tops of the pontoons to form a deck. Such boats also usually have a rather shallow draft in comparison to conventional V-bottom hull designs because they offer relatively greater static buoyancy due to a relatively significantly larger surface area of the hull being in contact with the water. On the other hand, pontoon boats are really deep displacement boats in that the contact of the pontoons with the water in motion tends to displace a relatively greater volume of water in comparison to a V-bottomed boat of similar weight and size. The pontoons may be generally in the form of hollow cylindrical shapes with their ends shaped more or less to points. The bottoms of the pontoons may be round or they may be V-shaped over all or part of their lengths. The reason why such hulls are relatively deep in displacement is that there is a relatively small vertical vector element of dynamic buoyancy to counteract gravitational forces produced by the weight of the boat; rather, the preponderance of dynamic buoyancy vectors are all perpendicular to the radiused curvature, or acute angles of the v-sections, of the pontoon hulls. Of course, this phenomenum also accounts for the relatively deep displacement of conventional v-hulled boats in the same manner.

Pontoon boats are also quite cumbersome to maneuver, again, due to a greater degree of keel action in contact with the water (tending to keep the boat going in a straight line) and relatively greater counteracting hydraulic sideways force being exerted against the pontoons at any given velocity (again, also tending to keep the boat going in a straight line). Such boats are, consequently, normally used for relatively slow-speed cruising.

Racing boats, i.e., "hydroplanes", have for years incorporated sponson-like shaping along the sides to provide stability, due to increased width, with that portion of the bottom of the hull, which extends between and connects the sponsons, being raised above the lower level of the sponson bottoms. In such boats, the sponson-like shapes are usually modified such that they are somewhat V-shaped to form a keel at the lowest extending edges of each sponson. Thus, in effect, conventional hydroplanes will have two small V-shaped hulls, each extending at least part way from bow to stern of the boat at the lateral extremities. Water is channeled between these sponson hulls at a somewhat greater velocity than outboard of the hulls, generally following the jet principle. This relatively increased water flow velocity tends to work against the central flat bottom to raise the boat to a plane. Once the boat is up on a plane, the increased speed, with corresponding increased hydraulic force against the two hulls, tend to raise the flat central portion even more to a point where it is substantially above the general level of the water, thus further reducing hydraulic forces against the hull and enabling even greater speeds.

The problem is that once the central flat portion of the hull on a hydroplane is raised above the water level, there is relatively little hydraulic force imposed on the two sponson hulls to stabilize the boat, and almost none on the central flat bottom. A brisk wave, moderate chop or a stiff wake, suddenly imposed on the hull, tends to raise the whole boat out of the water and can easily flip the boat; at high speed, such a flip frequently proves to be fatal. What gas happened is that the curved-up prows, of the two sponsons, have actually wedged the whole boat up out of the water.

Water skis have also been known for years, and the sport of water skiing has grown into a sport that is engaged in by many people. Special ski boats have been designed to tow water skiers, although conventional outboard, inboard-outboard and inboard engine driven boats are also widely used for the sport of water skiing, provided they can reach sufficiently high speeds to enable the water skier, being towed behind, to get up erect (or semi-erect) and to induce his or her water skis to, more or less, plane on top of the water surface. To date, however, it appears that there has been no attempt to develop self-propelled water skis.

Water skis tend to generate and throw up a relatively great amount of spray, making it quite difficult for persons upon those skis to be able to see sufficiently at all times to be able to safely navigate a body of water. This is not such a great problem if the water skis and person upon them are being towed, for example, by a ski boat, the pilot of which can anticipate problems because he or she is not affected by the spray generated by the following, towed water skier and skis.

The problem, seemingly inherent in conventional water ski designs, is that the skis develop a substantial amount of spray, mostly generated by the foreword, up-tipped or upwardly curved ends thereof as those foreword ends act as the leading edges of the water skis in regard to forward motion contact with water. This problem becomes increasingly exacerbated in direct proportion to the degree of roughness of the water. That is to say, should the leading edges of a pair of water skis dynamically encounter glass-smooth water, the spray problem is not unduly excessive, however substantial spray is still quite evident. However, since water skiers are normally towed by power boats, those boats which create substantial wake and turbulence following behind, relatively rough water is ever present, to a greater or lesser degree, in regard to the leading edges of the water skis. This spray, at times, can block or obscure the view of the skier to the point of being hazardous. Recently, it has become somewhat popular to tow water skiers with low flying aircraft. This option tends to reduce to degree of rough water which the leading edges of the water skis encounter. However, little if anything has been done to incorporate features into water ski designs which serve to reduce or eliminate spray produced by the leading edges of those skis coming into dynamic contact with the water through forward motion.

SUMMARY OF THE INVENTION

The present invention provides, in effect, the concept of incorporating the design of water skies into the hull of a watercraft, to produce what might be thought of, in generalized analogy, as the first self-propelled set of multiple water skis, hereinafter referred to as the "ski-toon" boat. Further, the present invention incorporates features which significantly reduce the excessive amount of spray produced by conventional water ski designs, thus virtually eliminating the entry of spray into the cockpit of the ski-toon boat, and which could eliminate the spray to a water skier utilizing these feature on otherwise conventional water skis.

With watercraft having either a v-hull or a ski-toon, static water displacement is relatively great, with the hulls sitting relatively deeper in the water, i.e., having a greater static draft, in comparison to a flat-bottom hulled watercraft. However, dynamic water displacement with the ski-toon is relatively generally equivalent to that of a flat bottom hull, or even less, in contrast to the relatively generally greater dynamic displacement of water, and corresponding generally deeper relative dynamic draft of v-hulled watercraft.

The following, in this Summary of the Invention, describes the preferred embodiment, except as otherwise noted. The present invention comprises a ski platform, incorporated into a ski-toon boat comprising a hull assembly which includes a ski platform assembly, the ski platform being mounted to the bottom of the hull assembly. To the top of the hull assembly is mounted a core frame. The core frame extends longitudinally substantially from the bow end to the stern end, and extends laterally substantially from side to side, of the ski-toon boat.

A gunwale assembly is mounted to and extends upwardly from the core frame. The gunwale assembly comprises a pair of spray shield sides, mounted to the core frame and extending upwardly therefrom. A side rail assembly is mounted to the top edges of the pair of spray shield sides, and a bumper rail assembly is mounted to and surrounds the mounting of the pair of spray shield sides to the core frame. A transom is also mounted to the core frame, extending upwardly therefrom. The transom is also mounted to each pair of the spray shield sides.

The core frame, the pair of said spray shields sides and the transom form a cockpit within the ski-toon boat, with the core frame forming the floor of the cockpit and the transom forming the rear or stern end of the cockpit.

The hull assembly comprises a center hull mounted longitudinally beneath the longitudinal center line of the core frame. The center hull comprises a pair of center hull sides, those center hull sides which are formed into a center prow at the bow end of the ski-toon boat. The center hull includes, at the stern end thereof, a center hull end. The top edges of the center hull are fixed to the core frame.

The hull assembly further comprises a pair of outer hulls, each of the pair of outer hulls being mounted adjacent to and beneath a side edge, respectively, of the core frame. Each of the pair of outer hulls extends longitudinally substantially from bow to stern of the core frame. Each of the pair of outer hulls comprises a pair of outer hull sides which are formed into an outer prow at the bow end of said ski-toon boat. Each of the pair of said outer hulls includes at the stern ends thereof, an outer hull end. The top edges of each of the pair of outer hulls is fixed to the core frame.

The ski platform assembly of the present invention comprises a center ski longitudinally mounted and fixed to the bottom edge of the center hull. The ski assembly further comprises a pair of outer skis, each of the pair of outer skis being respectively longitudinally mounted and fixed to a bottom edge of each of the pair of outer hulls.

The bottom edges of the center hull and the bottom edges of each of the pair of outer hulls are curved upwardly at the bow ends thereof. The center ski is curved upwardly at the bow end thereof to match the upward curvature of the bottom edge of the center hull. Likewise, each of the pair of outer skis is curved upwardly to match the upward curvatures respectively of the bottom edge of each of the pair of outer hulls.

Each of a pair of strakes is mounted to the bottom of the center ski and fixed thereto at a position adjacent to the side edges of the center ski. Each of the pair of strakes extends downwardly from the center ski, and each of the pair of strakes extends longitudinally and parallel to each other from the stern end of the center ski toward the bow end thereof for a distance not exceeding about one half the length of the center ski.

Prow shield means extend upwardly and aftwardly, respectively, from the center ski and each of the pair of outer skis. The prow shield means function to substantially prevent water from reaching the upper surfaces of the upwardly curved bow ends of the center ski and each of the pair of outer skis, respectively.

The prow shield means, in relation to each of said skis, comprises a prow shield positioned such that the upper edges of the upwardly curved bow ends of each of said skis is not exposed to oncoming water. Each of those prow shields which, respectively, substantially covers the prow end of each of the hulls. Alternatively, each of the prow shields may form the prow end, respectively, of each of the hulls. As another alternative, each of the prow shields may, respectively, be an integral part of each of the hulls.

Water spreader means are mounted to the lower surfaces of the upwardly curved bow ends of the center ski and each of the pair of outer skis. The water spreader means function to separate and spread water which reaches the bow ends, respectively, of the center ski and each of the pair of outer skis.

The water spreader means comprises a water spreader which, in turn, comprises a v-shaped structure having vertically flat surfaces and a sharp vertical edge where the vertically flat surfaces adjoin. There is a water spreader for each ski. Each of the water spreaders, respectively, is mounted to the bottom surface of each of the upwardly curved bow ends of each of the skis. Each of those so mounted water spreaders is positioned to extend vertically downwardly, respectively, from each of the upwardly curved bow ends of each of the skis, with the sharp vertical edge of each of the water spreaders being positioned to extend vertically downwardly, respectively, from the bow point of each of the skis. Each of the water spreaders extends horizontally aftwardly, respectively, to a point on the bottom surface of each of the skis at which there is, respectively, a transition of the upwardly curved bow end of each ski to a flat bottom surface. The aftward extension of each of the water spreaders is terminated at the parallel sharp edges, respectively, of each of the skis. (The sharp edges of each of the skis, from the aforementioned transition point, also known as the elevational transition point, to the stern end of each ski, are parallel with each other.) Each of the water spreaders, respectively, is mounted horizontally inwardly (or inset) from the sharp edges of each of the skis. (The sharp edges of each of the skis, from a point, know as the plan transition point, which is forward of the elevational transition point, to the bow point of that ski, are not parallel, but rather, taper forward and to the bow point.)

The center ski preferably extends laterally beyond the lower edges of the center hull and each of the pair of outer skis, respectively, preferably extends laterally beyond each of the lower edges of the pair of outer hulls.

Preferably, the center hull and the center ski are truncated at a position forward of the transom and preferably each of the pair of outer hulls and each of the pair of outer skis extends rearward from the transom of the ski-toon boat.

More specifically, the present invention comprises a ski platform assembly comprising a center ski, longitudinally mounted and fixed to the bottom edge of a hull, and a pair of outer skis, each of that pair of outer skis being respectively longitudinally mounted and fixed to a hull. The center ski is curved upwardly at the bow end thereof, and each of the pair of outer skis is also curved upwardly at the bow end thereof.

Each of a pair of strakes, each is mounted to the bottom of the center ski, each strake being fixed to the bottom of that center ski at a position adjacent to the opposite side edges of the center ski, with each of the pair of strakes extending downwardly therefrom. The pair of strakes extend longitudinally and parallel to each other from the stern end of the center ski toward the bow end of that center ski for a distance not exceeding one half the length of the center ski.

Prow shield means extends upwardly and aftwardly, respectively, from the center ski and each of the pair of outer skis. The prow shield means function to substantially prevent water from reaching upper surfaces of the upwardly curved bow ends of the center ski and each of the pair of outer skis, respectively.

The prow shield means, in relation to each of the skis, comprises a prow shield positioned such that the upper edges of the upwardly curved bow ends of each of the skis is not exposed to oncoming water. Each of those prow shields, respectively, substantially covers the prow end of each of the hulls. Alternatively, each of the prow shields may form the prow end, respectively, of each of the hulls. As another alternative, each of the prow shields may, respectively, be an integral part of each of the hulls.

Water spreader means function to separate and spread water which reaches the bow ends, respectively, of the center ski and each of the pair of outer skis. The water spreader means are mounted to the lower surfaces of the upwardly curved bow ends of the center ski and to each of the pair of outer skis.

The water spreader means comprises a water spreader which, in turn, comprises a v-shaped structure having vertically flat surfaces and a sharp vertical edge where the vertically flat surfaces adjoin. There is a water spreader for each ski. Each of the water spreaders, respectively, is mounted to the bottom surface of each of the upwardly curved bow ends of each of the skis. Each of those so mounted water spreaders is positioned to extend vertically downwardly, respectively, from each of the upwardly curved bow ends of each of the skis, with the sharp vertical edge of each of the water spreaders being positioned to extend vertically downwardly, respectively, from the bow point of each of the skis. Each of the water spreaders extends horizontally aftwardly, respectively, to a point on the bottom surface of each of the skis at which there is, respectively, a transition of the upwardly curved bow end of each ski to a flat bottom surface. The aftward extension of each of the water spreaders is terminated at the sharp edges, respectively, of each of the skis. (The sharp edges of each of the skis, from the aforementioned transition point, also known as the elevational transition point, to the stern end of each ski, are parallel with each other.) Each of the water spreaders, respectively, is mounted horizontally inwardly (or inset) from the sharp edges of each of the skis. (The sharp edges of each of the skis, from a point, know as the plan transition point, which is forward of the elevational transition point, to the bow point of that ski, are not parallel, but rather, taper toward and to the bow point.)

An alternate embodiment of the present invention does not use three skis; rather, the center ski is eliminated. In this embodiment the present invention comprises a pair of skis, each of that pair of skis being respectively longitudinally mounted to an object to be moved through and over the surface of water. That object could be a boat hull, or it could comprise a pair of pontoons on a sea plane, or it could comprise a pair of human feet. Each of the pair of skis is curved upwardly at the bow end thereof. Each of that pair of skis comprises prow shield means extending upwardly and aftwardly, respectively, from each of the pair of skis. The prow shield means, if employed, function to substantially prevent water from reaching the upper surface of the upwardly curved bow end of each of that pair of skis, respectively. Further, each of the pair of skis comprises water spreader means which function to separate and spread water which reaches the bow ends, respectively, each of that pair of skis. The water spreader means are mounted to the lower surface of the upwardly curved bow end of each of the pair of skis.

Each of the water spreader means comprises a water spreader which comprises a v-shaped structure comprising vertically flat surfaces and a sharp vertical edge where the vertically flat surfaces adjoin. Each of the water spreaders, respectively, is mounted to the bottom surface of each of the upwardly curved bow ends of each of the skis. Each of the so mounted water spreaders is positioned to extend vertically downwardly, respectively, from each of the upwardly curved bow ends of each of the skis, the sharp vertical edge of each of the water spreaders being positioned to extend vertically downwardly, respectively, from the bow point of each of the skis. Each of the water spreaders extends horizontally aftwardly, respectively, to a point on the bottom surface of each of the skis at which there is, respectively, a transition of the upwardly curved bow end of each ski to a flat bottom surface, with the aftward extension of each of the water spreaders being terminated at the parallel sharp edges, respectively, of each of the skis. (The sharp edges of each of the skis, from the aforementioned transition point, also known as the elevational transition point, to the stern end of each ski, are parallel with each other. The sharp edges of each of the skis, from a point, know as the plan transition point, which is forward of the elevational transition point, to the bow point of that ski, are not parallel, but rather, taper toward and to the bow point.)

These and other features of the present invention will be more fully explained and shown respectively in the following detailed description and the accompanying drawings.

DETAILED DESCRIPTION

Figure 1:
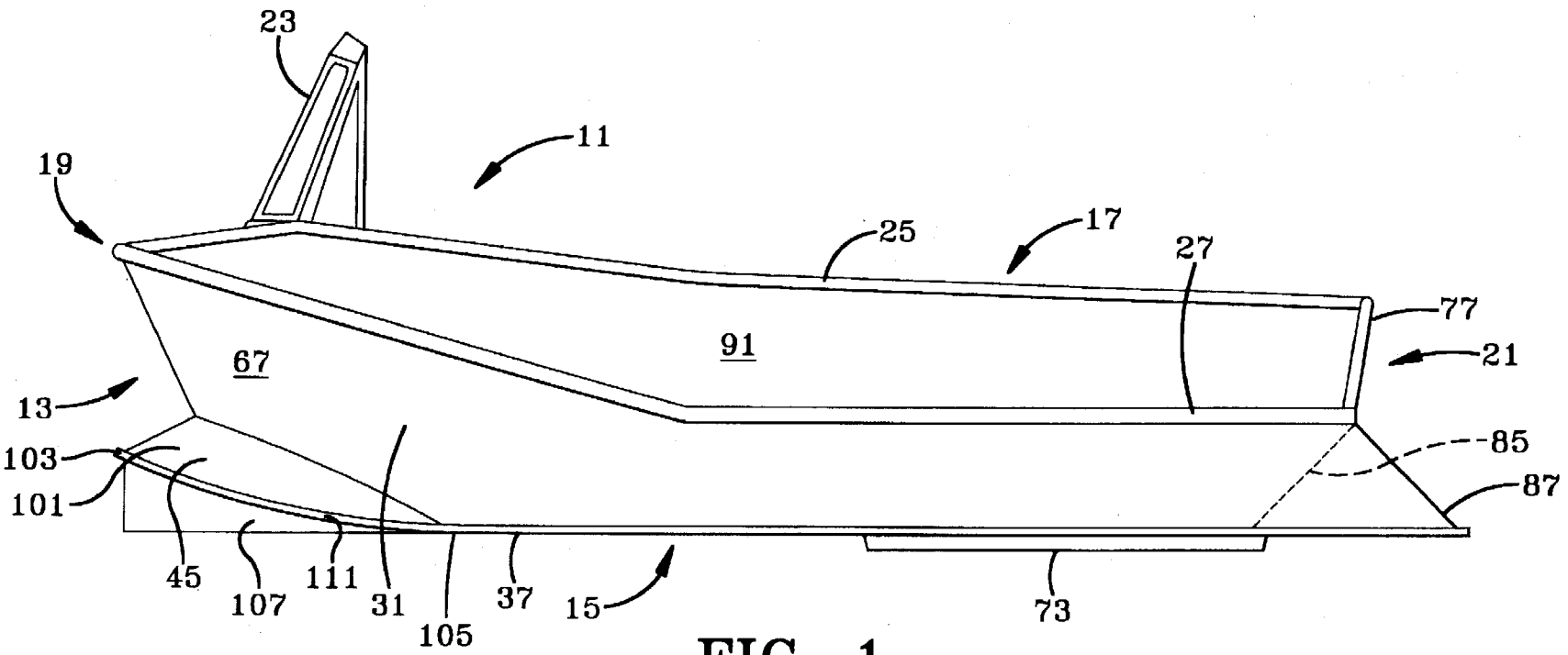
FIG. 1 is a semi-schematic elevational view of the ski-toon boat as viewed from its left side, showing the front or bow of the boat to the viewer's left and the rear or stern of the boat to the viewer's right.

Following is a description of a boat hull referred to hereinafter as the "ski-toon". It has been discovered that "roll" stability is greater with flat bottom hulls than with conventional V-shaped hulls for boats of relatively equivalent weights and sizing. Roll stability is generally a function of the width of the boat in relation to the elevation of the center of gravity of the boat above the flat bottom.

The preferred embodiment of the ski-toon boat is a watercraft preferably built out of plate or sheet aluminum with welded seams, although the hull and substantially the overall boat could be fabricated from other materials such as, for example, FRP, high density polyethylene, other metals, etc.

The basic functional features of the ski-toon boat are:

1. that it rides on top of the water on flat "ski" surfaces;
2. that it cuts through waves or wakes of other boats with no pounding and very little rocking or pitching motion as it pierces the water waves; and
3. that there is significantly reduced spray produced by the flat ski surfaces in comparison to conventional water ski designs.

These three functional features are accomplished by:

1. sizing the flat area of the bottom surfaces in relation to the gross weight of the boat;
2. using multiple deep V-hulls which are very pointed at the bow; and
3. incorporating prow shields and water spreaders into the design of the ski leading ends extending forward from the flat ski surfaces.

The ski-toon's load carrying capacity is great; empty weight is low compared to gross weight. The multiple hull sides give substantial extra strength to support large loads. Without the usual hard pounding of conventional boats, this strong and rigid boat knifes through the water, and therefore the sound level is low inside and outside the ski-toon, as the wave pounding encountered by conventional hulled boats is all but eliminated. Spray reduction features are incorporated into the design as will hereinafter be explained.

With conventional boats that maintain deep displacement throughout the operating range, as opposed to the ski-toon with its shallow displacement in cruise, there is a much different transition from "at rest" to cruise and return to "at rest". The ski-toon maintains a relatively level attitude and therefore more of a constant propeller angle in relation to the travel and pitching of the boat. More specifically, from "at rest" up to full velocity, the ski-toon bow initially rises a few degrees (normally not more than about 4°), followed by a compensating rise of the stern as the ski-toon begins to approach a plane; then as planing is achieved the whole ski-toon merely gradually rises substantially straight up.

With a conventional v-hulled boat, and also with a bass boat, during transition from "at rest" to a plane, the hull must climb over a bow wave, which progressively moves from bow to stern as the velocity of the boat progressively increases. Thus, in both cases, the bow lifts or tilts upwardly to a significant degree, as the bow wave works its way from the bow toward the stern. Only when the bow wave has passed the longitudinal center of gravity point of the boat, does the bow begin to lower, as the stern begins to climb up over the bow wave. Finally, the bow wave progresses more toward the stern to the point where the boat has achieved a plane. This significant up-tilt of the bow tends to block the forward view of the pilot, thus causing potential safety problems. Further, the constant push of the boat against the bow wave, until planing is achieved, creates a need for greater engine power, per increment of forward motion, and thus significantly reduces fuel efficiency. The ski-toon, on the other hand, slices through any bow wave that begins to develop, as the flat "ski bottoms" pop the boat up on top of the water, at a relatively substantially lower velocity, where it remains in an essentially level attitude (normally with the ski bottoms being uptilted at an angle of about 4° in relation to the general plane of the water surface) as velocity further increases. Because there is considerably less pushing of bow waves, to achieve planing with the ski-toon boat, less engine power is required, per increment of forward motion, thus less fuel is consumed during the transition from "at rest" to a plane.

With a conventional v-hulled boat, and also with a bass boat, relatively greater propeller tilt or "trimming" is necessary to quickly transition from "at rest" to a plane, as the propeller must both drive the boat forward and upward over the bow wave. With the ski-toon, no propeller trim or tilt is necessary, as the ski-toon achieves a plane very quickly, at a significantly lesser velocity, before any initial small bow wave that is created has moved rearward from the bow to any significant degree. The spray reduction features of the ski-toon design, in effect, tend to greatly reduce any tendency to create a bow wave, as the spray reduction features tend to channel the water to the side as the ski-toon boat is raised up onto a plain, rather than allowing water to push against and underneath the bow ends of the skis. The result is that relatively little, if any, of the bow wave phenomenum is ever encountered by dynamic forward motion of the ski-toon boat; that which is encountered serves to hold the ski bottoms at about a 4° upward cant, at the bow end, in relation to the general plane of the water surface.

Referring to FIG. 1, the ski-toon boat 11 comprises a hull assembly 13. A ski platform assembly 15 is mounted to the bottom of hull assembly 13. A gunwale assembly 17 is mounted above hull assembly 13. As shown in FIG. 1, the bow 19 is positioned to the left on the drawing figure and the stern 21 is positioned to the right of the drawing figure. A windshield 23 is mounted to the ski-toon boat 11 extending above the gunwale assembly 17 and toward the bow 19. The gunwale assembly is surrounded by a side rail assembly 25 and a bumper rail assembly 27.

Figure 2:
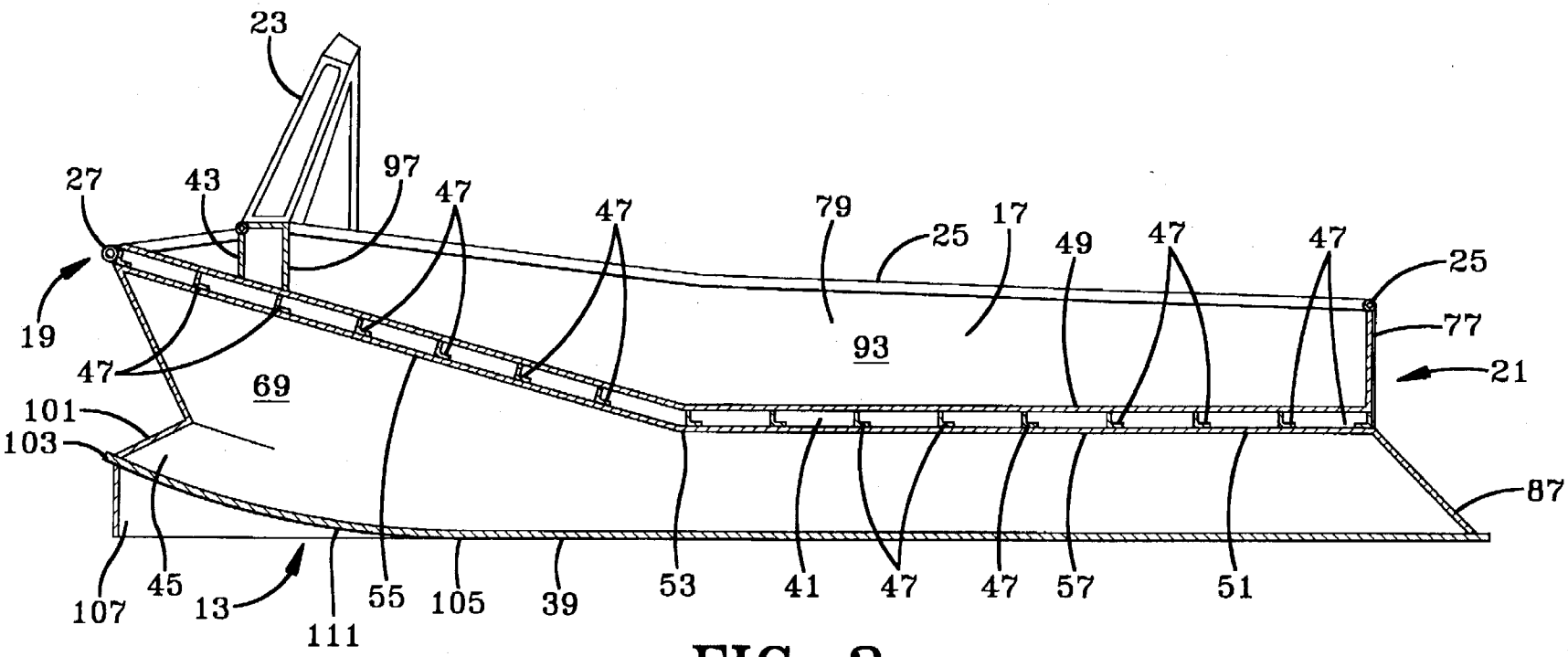
FIG. 2 is a semi-schematic cut-away elevational view of the ski-toon boat as viewed from I—I as shown on FIG. 5, showing the front or bow of the boat to the viewer's left and the rear or stern of the boat to the viewer's right.
Figure 4:
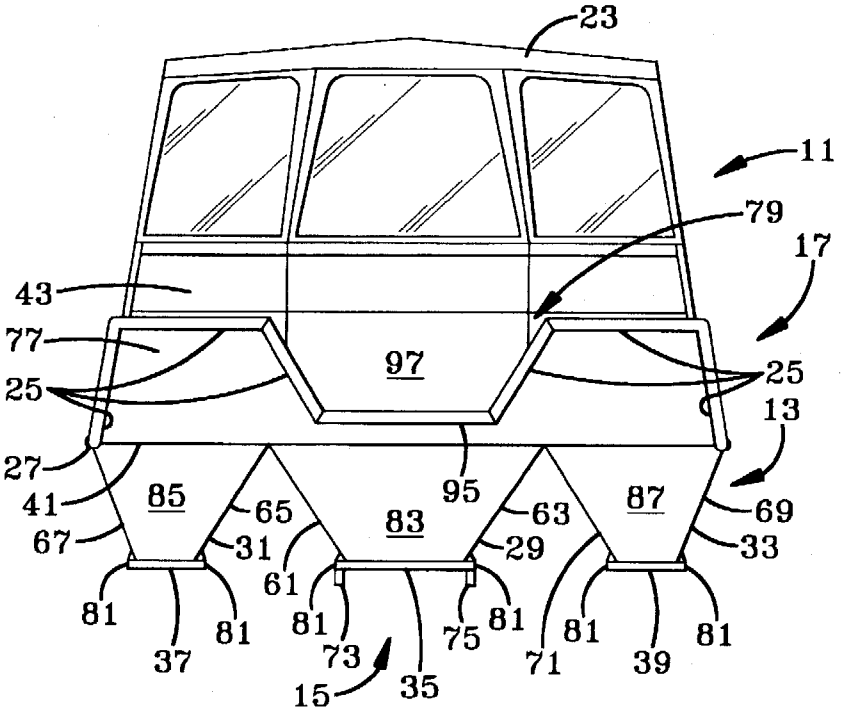
FIG. 4 is a semi-schematic rear or stern elevational view of the ski-toon boat, showing the boat as a viewer would see it looking straight on at the stern of the boat.
Figure 3:
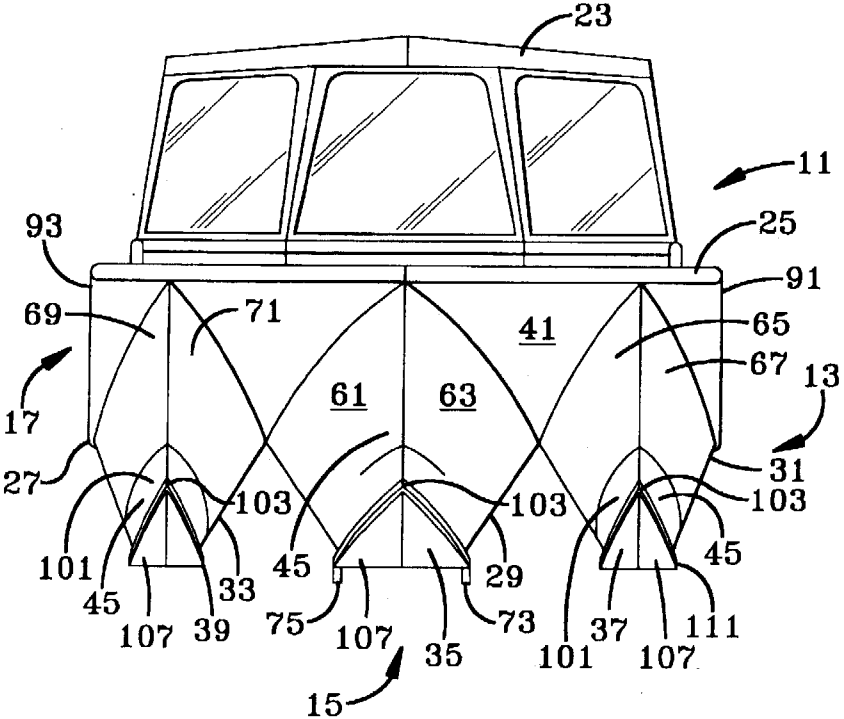
FIG. 3 is a semi-schematic front or bow elevational view of the ski-toon boat, showing the boat as the viewer would see it looking straight on at the bow of the boat.
Figure 6:
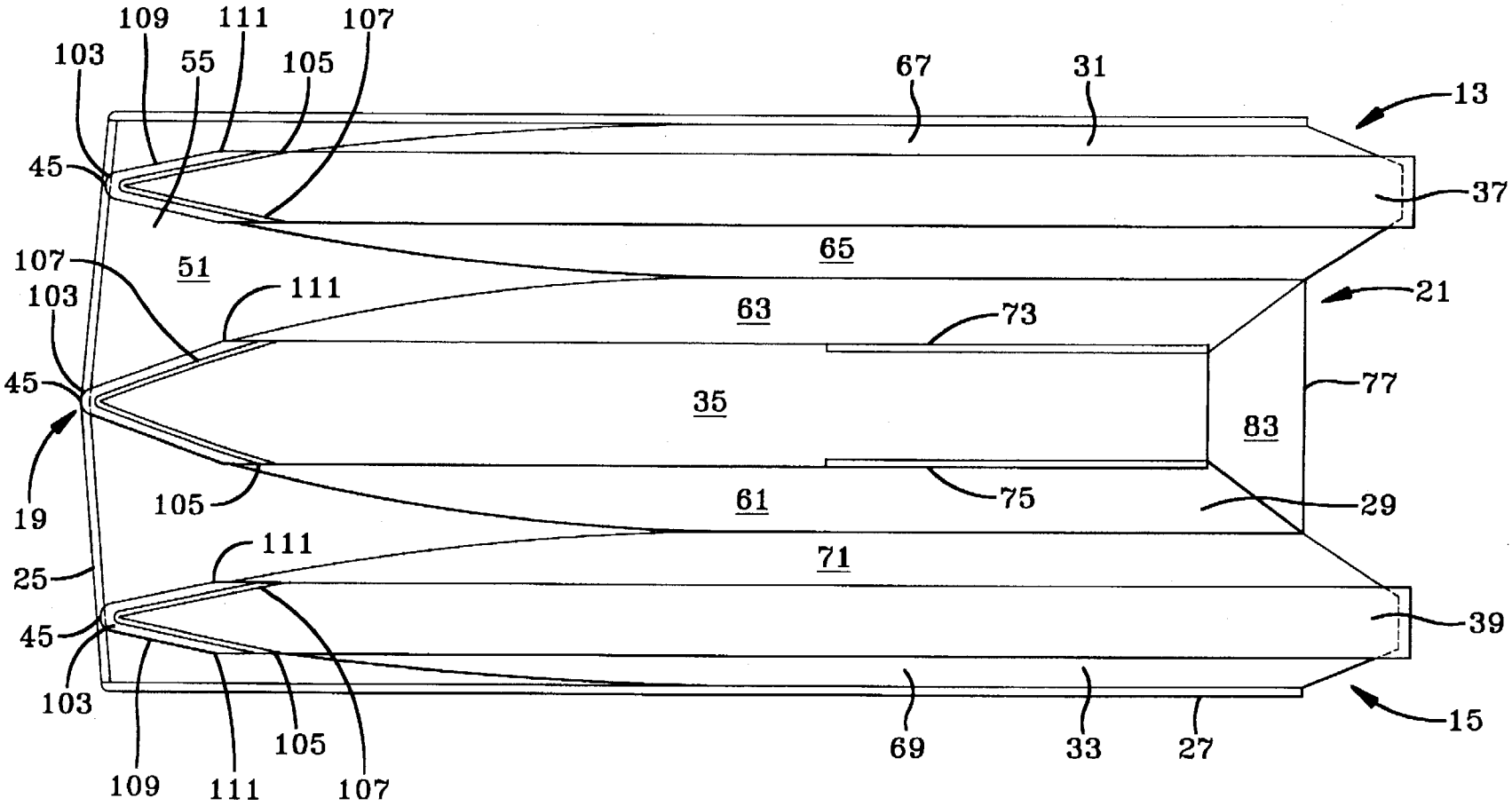
FIG. 6 is a semi-schematic contra-plan view of the ski-toon boat as viewed looking straight up from beneath the boat.

As shown in FIGS. 3, 4 and 6, hull assembly 13 comprises a center hull 29 and two outer hulls 31 and 33. Ski platform assembly 15 comprises a center ski 35, mounted to the bottom of center hull 29, and two outer skis 37 and 39, respectively mounted to the bottoms of outer hulls 31 and 33. As shown in FIG. 2, hull assembly 13 further comprises a core frame 41 to which center hull 29 and outer hulls 31 and 33 are mounted, extending downwardly therefrom as shown in FIGS. 3 and 4. Also mounted to core frame 41, extending upwardly therefrom, is gunwale assembly 17; bumper rail assembly 27 is also mounted to core frame 41. Further, as shown in FIG. 2, mounted to core frame 41, and projecting upwardly therefrom, is dashboard 43 to which, in turn, windshield 23 is mounted.

The preferred embodiment ski-toon boat 11 incorporates hull assembly 13 which comprises three (3) hulls (similar to pontoon style), those being center hull 29 and outer hulls 31 and 33, with skis mounted onto each of the bottoms thereof, those being center ski 35, mounted to center hull 29 and outer skis 37 and 39 mounted, respectively, to outer hulls 31 and 33. The skis, including center ski 35 and outer skis 37 and 39, in combination, are preferably sized to a hull assembly 13 load factor of 70 lbs. of gross weight per square foot of ski flat bottom, although it has been found that load factors in the range of about 60 lbs. to about 80 lbs. per square foot of ski flat bottom will function acceptably in the ski-toon boat 11. With a greater loading of the hull assembly 13, above about 80 lbs. per square foot, relatively greater engine power is required as the velocity needs to be increased significantly to permit the ski-toon boat 11 to get up on a plane. On the other hand, with a lesser loading of the hull assembly 13, less than about 60 lbs. per square foot, although the ski-toon boat 11 will plane at a lesser velocity, a potential for some degree of control loss begins to develop due to relative lack of lateral water pressure, generated by velocity, on the sides of the hull assembly 13, in comparison to similar hull assembly 13 loadings of the preferred embodiment.

The bow 19 ends of the hulls 29, 31 and 33 of the ski-toon boat 11, in the preferred embodiment, are each shaped in the form of a high, sharp, and pointed, forward-extending prow 45 (or a prow shield 101 as will be hereinafter explained), each in the shape of an arrowhead (as viewed from both a side, elevational view such as FIG. 1 and from a cut-away plan view such as FIGS. 9, 10 and 11) at the bow point 103 such that each of the "water ski" shaped skis 35, 37 and 39 are enabled to pierce on-coming waves. Correspondingly, the bow points 103 of skis 35, 37 and 39 are similarly formed in the shapes of arrowheads. Thus, the water from any initially developing bow wave is penetrated, with that water flowing above and to the sides of the prows 45 (or prow shields 101, as the case may be) and the upwardly curved section of the skis 35, 37 and 39 which extend from bow points 103 to elevational transition points 105 (as will be hereinafter explained), as well as beneath the flat bottom portions of the skis 35, 37 and 39, aft of elevational transition points 105. The width to length ratio of each arrowhead shaped prow 45 (or prow shield 101, as the case may be), as well as for the upwardly curve portions of skis 35, 37 and 39 (which extend from bow points 103 to elevational transition points 105) establish the piercing capability of each hull 29, 31 and 33, as will be readily understood by those skilled in the art of hull design.

Figure 8:
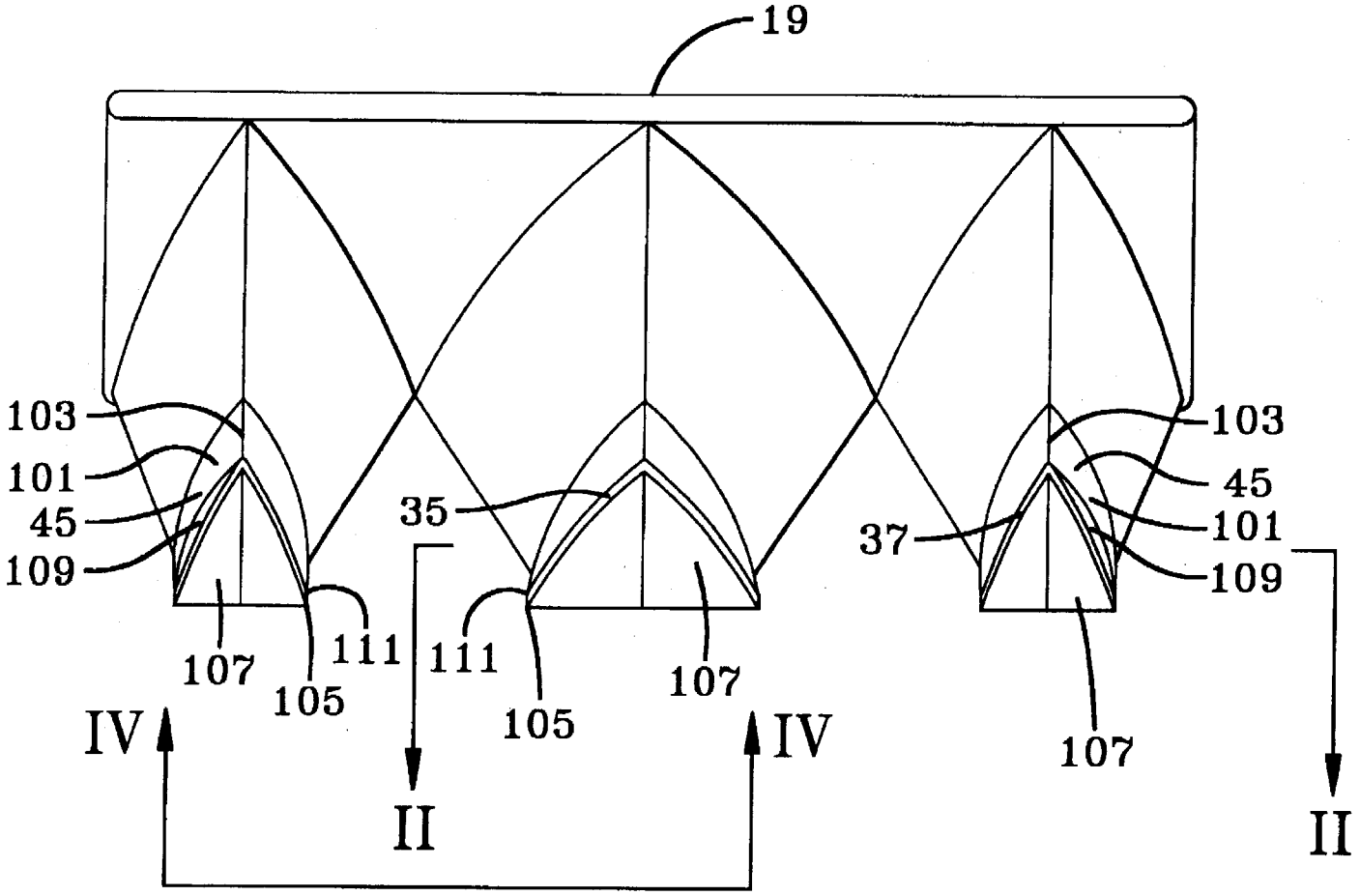
FIG. 8 is a partial, semi-schematic, front elevation view of the hull portion of the ski-toon boat, illustrating enhanced spray reduction features.
Figure 9:
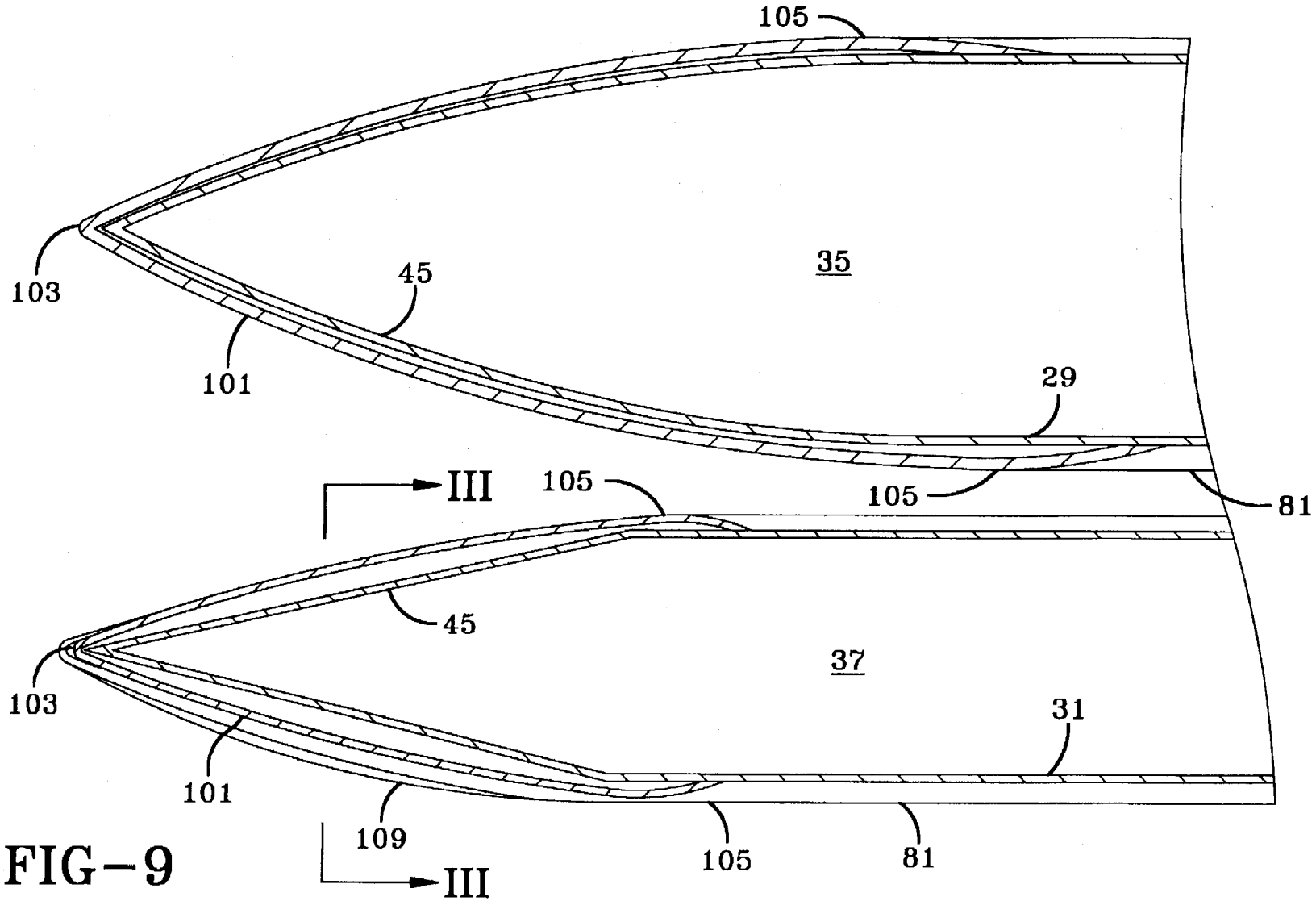
FIG. 9 is a partial, cut-away, semi-schematic, plan view of the front portion of an outer hull and center hull section of the ski-toon boat, as viewed from II—II of FIG. 8, illustrating enhanced spray reduction features.

In the preferred embodiment, outer skis 37 and 39 each incorporate a prow shield 101 with the prows 45. Preferably, center ski 35 also includes a prow shield 101 with its prow 45 as shown in FIGS. 8 and 9, but optionally, center ski 35 may not include a prow shield 101 with its prow 45 as shown in FIG. 3. The prow shields 101 serve to prevent oncoming water from contacting any surface of the outer skis 35 and 37 (and preferably center ski 35) except the bottoms and the sharp ski surfaces edges 81 adjacent thereto; that is to say that the prow shields 101 prevent oncoming water from contacting the top or upper surfaces of the skis at any point on the forward upward curving bow ends of those outer skis 35 and 37 (and preferably center ski 35).

Figure 7:
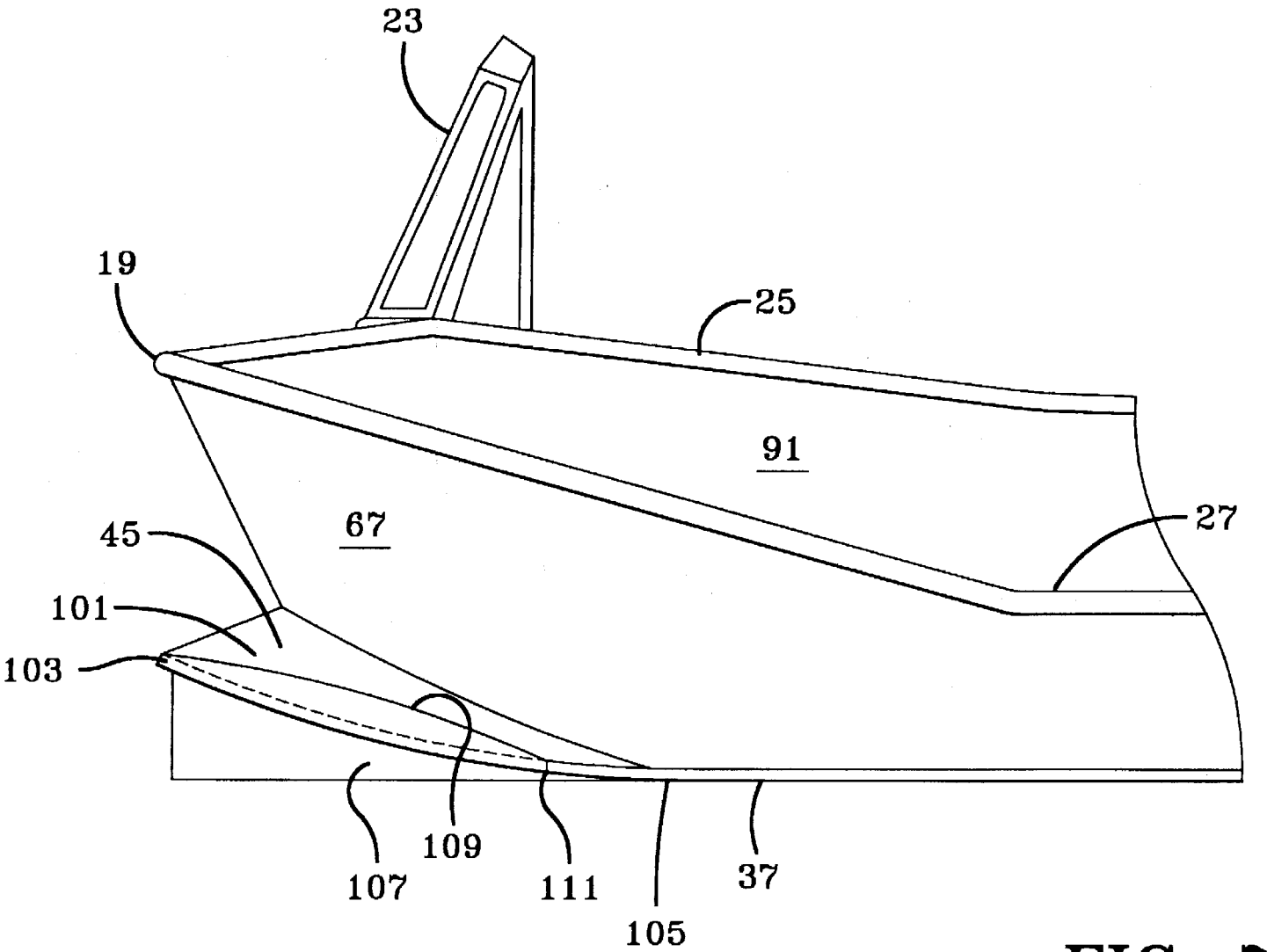
FIG. 7 is a partial, semi-schematic, side elevational view of the front portion of the ski-toon boat, illustrating enhanced spray reduction features.
Figure 10:
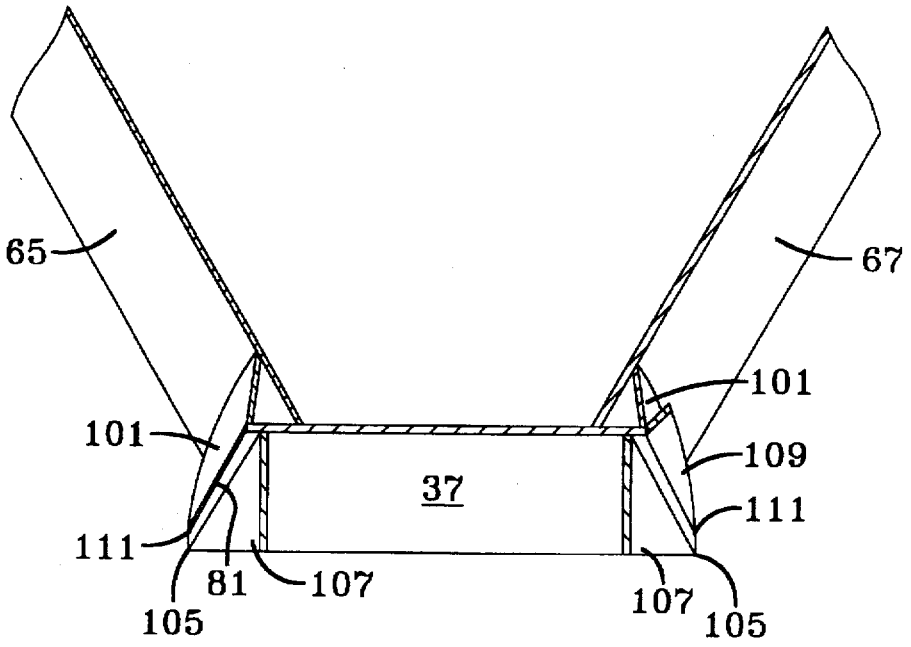
FIG. 10 is a partial, enlarged, cut-away, semi-schematic front elevational view of an outer hull portion of the ski-toon boat, as viewed from III—III of FIG. 9, illustrating enhanced spray reduction features.

The prow shields 101 extend from the bow point 103 of each of the outer skis 37 and 39 (and preferably center ski 35) toward the stern of the ski-toon boat 11 to about the elevational transition points 105 where the upward curvatures of those skis, 35, 37 and 39 transcend into straight sections which extend aftward, toward the stern 21 of the ski-toon boat 11, as shown in FIG. 7. The prow shields 101, which are fixed to both the inner and outer sharp ski surface edges 81 of the outer skis 37 and 39 (and preferably center ski 35), substantially cover the prow 45 surfaces of outer hulls 31 and 33 (and preferably center hull 29) about as shown in FIG. 9. Alternatively, prow shields 101 could replace the prows 45 of outer hulls 31 and 33 and/or center hull 29 as they are shown in FIGS. 7, 8 and 10. As a second alternative, the prow shields 101 could be incorporated as integral parts of outer hulls 31 and 33 and/or center hull 39 in the manner shown in FIG. 11, much in the way that prow 45 is shown incorporated into center hulls 29 as shown in FIGS. 3.

Figure 5:
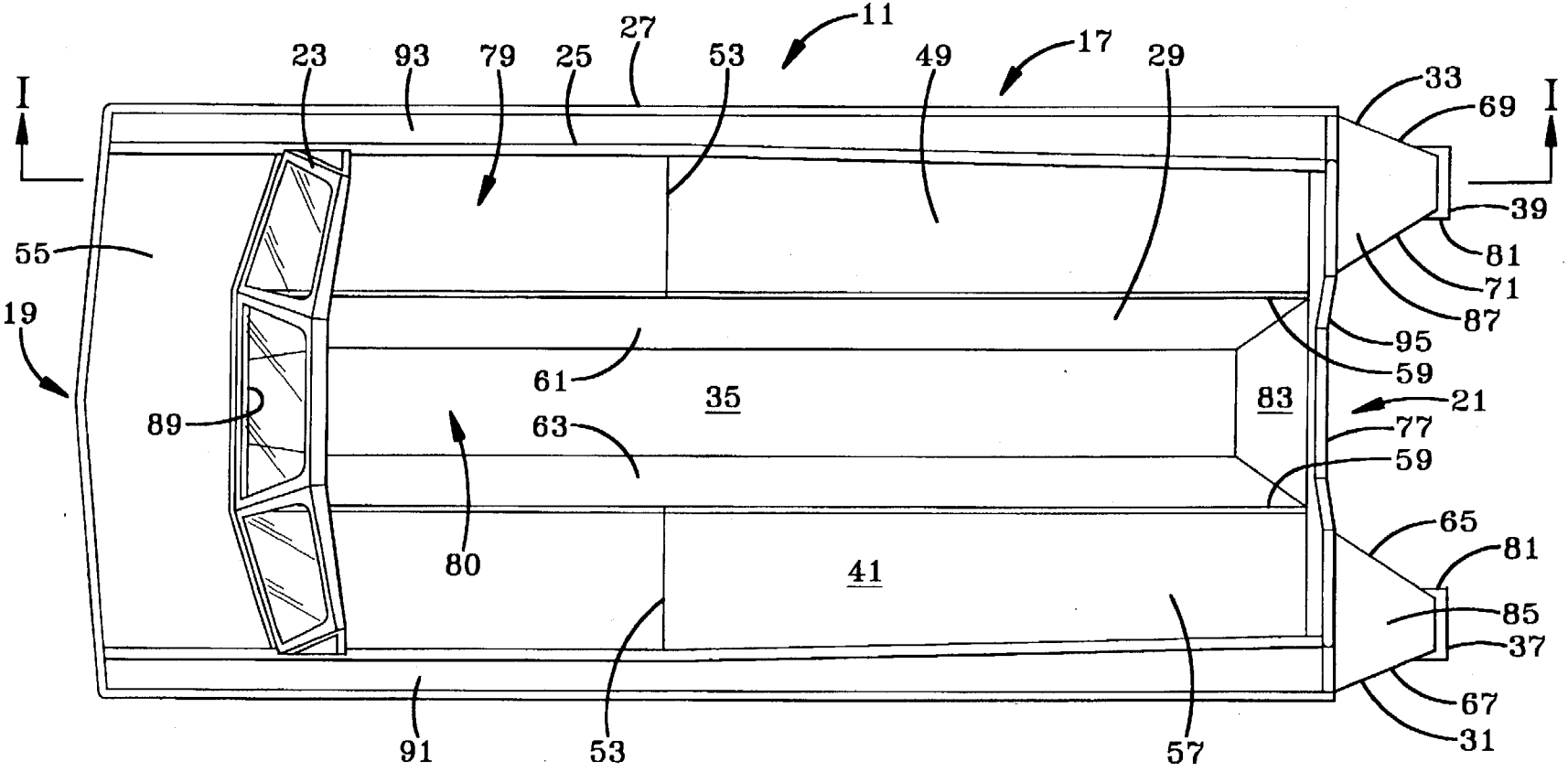
FIG. 5 is a semi-schematic plan view of the ski-toon boat as viewed from above the boat looking straight downwardly.

As mentioned above, the prow shields 101 eliminate the exposed upper surfaces of outer skis 37 and 39 (and preferably center ski 35) in the forward upwardly curved bow 19 portions of those skis 35, 37 and 39 extending from bow point 103 to elevational transition points 105, those upper surfaces which otherwise do extend outwardly from hull sides 61, 63, 65, 67, 69 and 71, as shown in FIG. 4, for those portions of skis 35, 37 and 39 which are flat and extend from elevational transition points 105 to beyond hull ends 83, 85 and 87, respectively, as shown in FIGS. 1, 2 and 5.

It has been discovered that a substantial portion of the spray, generated by the forward movement of conventional water skis through water, is created by a rush of water over the sharp ski surface edges of the upwardly curved forward portion of those water skis, more specifically by the discrete water turbulence as it rolls over and around those sharp edges. The Addition of the prow shields 101 to skis 35, 37 and 39 significantly reduces the volume of spray produced by those skis 35, 37 and 39, such spray which otherwise potentially might be projected upwardly over the bow 19 and over spray shield sides 91 and 93 to enter the cockpit 79 of the ski-toon boat 11.

Of course, with the foregoing discovery in mind, it now stands to reason that a reduction in the volume of water which reaches the upwardly curved forward portions of water skis, generally, correspondingly reduces the existing potential for spray to be created. To this end, water spreaders 107 have been added to the bottom surfaces of the upwardly curved forward portions of outer skis 37 and 39 and also to the upwardly curved forward portion of center ski 35.

Figure 12:
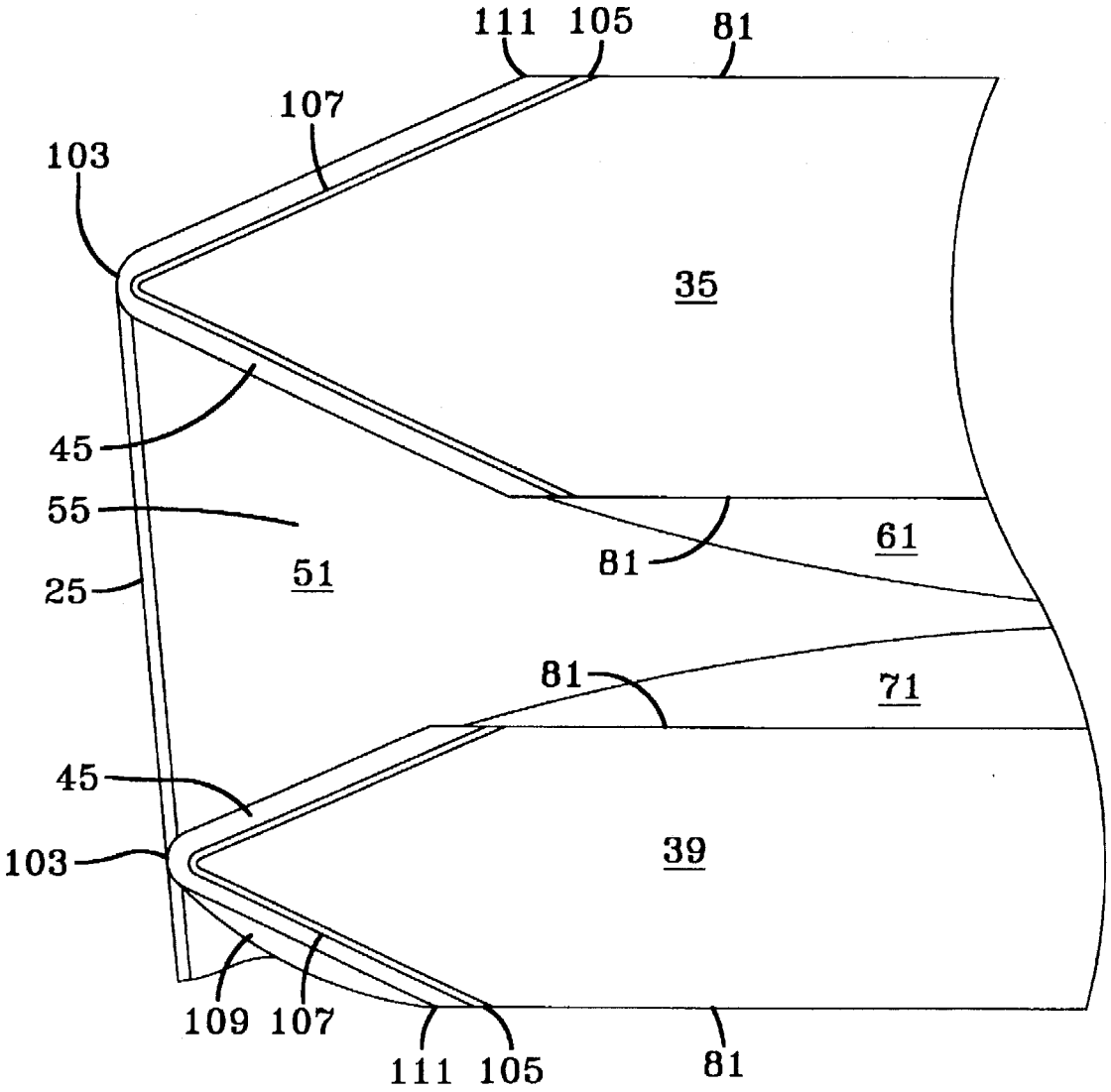
FIG. 12 is a partial, cut-away, semi-schematic contra-plan view of the ski-toon boat, looking straight up from beneath the boat, particularly as viewed from IV—IV of FIG. 8, illustrating enhanced spray reduction features.

Each water spreader 107 is formed by bending a sheet or plate of material (or welding 2 sheets or plates together to form an equivalent v-bend), preferably aluminum, to have a sharp edged included angle which generally is equivalent to the included angle of the bow point 103 end, respectively, of each ski, 35, 37 and 39, those included angles which terminate at plan transition points 111, as shown in FIG. 12. The thusly bent (or welded) sheets or plates are then positioned vertically, and the upper edge of each is trimmed to mate with the upward curvature of each forward portion of each respective ski 35, 37 and 39 so that the outer vertical faces of each of the water spreaders 107 are preferably horizontally inset from the lower sharp ski surface edges 81 of each respective ski 35, 37 and 39, in those areas of the skis which extend forward from the elevational transition points 105 to the bow points 103, about as illustrated in FIG. 7 in respect to outer ski 37. The degree of inset in the preferred embodiment ranges from about 2"adjacent to the elevational transition points to an inset, at the bow point, of about ⅓ the vertical height of the water spreaders 107 at that bow point 107 end of the skis 35, 37 and 39. The reason for such an inset will be hereinafter explained. On the other hand, the aft ends of the water spreaders 107, which extend aftwardly to or beyond the elevational transition points 105, in all cases extend to the lower sharp ski edges 81 of each respective ski 35, 37 and 39 aft of plan transition points 111, as shown in FIG. 12. The reason for such extensions, likewise, will be hereinafter explained. Then each of the water spreaders 107 is mounted, for example by welding, to the bottom of the upward curving forward portion of each respective ski, 35, 37 and 39.

As will be noted from viewing FIGS. 7 and 8, each water spreader 107 may extend downwardly, preferably no more than about ½", from the bottom plane of the flat portion of each ski 35, 37 and 39. Preferably, however, for general purpose use of the ski-toon boat 11, the bottom edge of each water spreader 107 is on the same plane, respectively, as the bottom plane of each ski 35, 37 and 39. The bottom edge of each water spreader 107 extends essentially parallel to the bottom plane, respectively, of each ski 35, 37 and 39. The reasons for such downward extension, or preferably a lack thereof, and such parallel arrangement will be hereinafter explained.

In regard to the upwardly curved portions of the skis 35, 37 and 39, it is preferred that, from the perspective of a plan view, as best viewed in FIG. 6, the included angles of the bow point 103 ends of those skis 35, 37 and 39 extend to the full widths of those skis at a point which is forward of elevational transition points 105, but aft of plan transition points 111, as shown in FIGS. 7 and 12. Thus, in the preferred embodiment of ski-toon boat 11, the elevational transition points 105 of skis 35, 37 and 39 (those being the points at which the upward curvature of those skis, extending from bow points 103 to elevational transition points 105, transcend into flat surfaces which extend aftwardly from elevational transition points 105, as best shown in FIGS. 1, 2 and 7), are invariably aft of plan transition points 111. The reason for this arrangement will be hereinafter explained.

The vertical outer surfaces of each water spreader 107 function to divert bow wave water horizontally away from, respectively, the upward curving forward portion, extending to the bow point 103, of each ski 35, 37 and 39, as the ski-toon boat 11 advances forward through the water, including periods of acceleration as the ski-toon boat 11 moves forward from a rest position up onto plane. It has been noted that the preferred embodiment of the ski-toon boat 11, when up on plane, raises the bow 19 in such a fashion (normally about 4°) that the elevational transition point 105 is about the same elevation level of the water line, and depending upon the degree of roughness of the water, the elevational transition point 105 may momentarily rise slightly above the water line, usually somewhat less than about ½" above that water line, such that the water line momentarily comes into contact with the skis 35, 37 and 39 usually not more than 6" to 8" aft of elevational transition points 105. Where the ski-toon boat is to be used normally in relatively rough waters, the downward, vertical extension of the water spreaders 107, to about ½" or less as mentioned above, may be beneficial. However, preferably, for general purpose use of the ski-toon boat 11, the water spreaders 107 do not vertically extend at all below the flat planes, respectively, of skis 35, 37 and 39. The object is to position the bottom edges of the water spreaders 107 to substantially just skim the surface of the water when the ski-toon boat 11 is up on plane, to just a sufficient degree to still divert the surface of the water outwardly from the forward upwardly curved portions, respectively, of skis 35, 37 and 39. If the bottom edges of water spreaders 107 are above, respectively, the bottom planes of skis 35, 37 and 39, given the current preferred embodiment design of the ski-toon boat 11 as described herein, they do not come into sufficient contact with the water, when the ski-toon boat 11 is up on plane, to divert much water out of the way. If the downward extensions of water spreaders 107 are much more than that which is necessary to permit the bottom edges to just skim the surface of the water when the ski-toon boat 11 is up on plane, i.e., a maximum of about ½", additional horsepower will be required to propel the ski-toon boat 11 forward at any given velocity while up on plane, as the water spreaders 107 will then begin to create additional, unnecessary drag, tending to make the bow points 103 dive, or porpoise, to some extent. Thus, given the current preferred embodiment of the ski-toon boat 11, as described herein, no downward extension of the bottom edges of the water spreaders 107 appears to be just about optimum, with a downward extension of no greater than about ½" being useful where normally relatively rough waters are encountered so that skimming contact is maintained to a greater extent, given the greater elevational variation of the surface of rough water. However, variations in design, within the scope of the claims hereinafter stated, will require some minor experimentation to optimize the degree of downward extension of the water spreaders 107, if any, within the parameters explained above, as will be well understood by those skilled in the art.

As mentioned above the mountings of the water spreaders 107 to the bottom surfaces of the forward upwardly curved portions of the skis 35, 37 and 39 are preferably horizontally inset from the sharp ski surface edges 81 of the skis 35, 37 and 39, preferably to the degree explained above. It has been found that when the inset is increased to the extent that it is significantly greater than about ⅓ of the height of the bow point 103 end of the water spreaders 107, the water spreaders have significantly reduced effectiveness as described herein. On the other hand, it is believed that the degree of this horizontal inset may be reduced or even eliminated without significant detrimental effect to the effectiveness of the water spreaders 107, as described herein. The water spreaders 107 substantially reduce the volume of oncoming water to reach the bottom surfaces of the forward upwardly curved portions of the skis 35, 37 and 39. Further, virtually all of the forward moving elements of the spray from that oncoming water are essentially eliminated. In comparison, conventionally designed water skis tend to develop spray which is shot forward and upwardly from the forward, upwardly curved portions of those skis, sort of in either a simple or a compound ricochet effect. As the skier moves forward on the skis, this spray element hits him or her in the face. Incorporation of typical conventional water ski design into the forward ends of skis 35, 37 and 39, in like manner, produces significant mist spray which covers the windshield, if used, and may splash a light mist of water into the cockpit 79. The relatively small sections of the skis 35, 37 and 39 which extend outwardly from the mountings of the water spreaders 107 to those skis, serves to further divert any residual elements of that spray to an essentially horizontal and rearward path. That small portion of the spray, which is not so horizontally diverted, is not subjected to further turbulence by virtue of the prow shields 101, as explained above, in regard to the outer skis 37 and 39 (and preferably center ski 35). Where center ski 35 does not utilize a prow shield 101, the small portion of that spray, not diverted by the outward extension of the center ski 35 from the mounting of its corresponding water spreader 107, is centered adjacent to the center of the bottom of the boat and is substantially trapped between the center hull 29 and the outer hulls 31 and 33, so there is somewhat less residual spray from the center ski 35 which can come up over the bow 19. However, to essentially eliminate the potential for spray coming up over the bow 19, it is considered beneficial to incorporate a prow shield 101 into the prow 45 of center ski 35 as well; this would be done in the same manner as described herein for incorporation of prow shields 101 into the prows 45 of outer skis 37 and 39 as shown in various drawing figures.

Also, as mentioned above, the aft ends of the water spreaders 107 extend aftwardly beyond plan transition points 111 to the lower sharp edges 81 of each respective ski 35, 37 and 39, as shown in FIG. 12. Those aft ends of water spreaders 107 preferably terminate at the elevational transition points 105, but may extend aftwardly therefrom in those cases, as explained above, where the water spreaders 107 extend vertically below the flat bottom plane surfaces of skis 35, 37 and 39 which extend aftwardly beyond elevational transition points 105. The extension of the aft ends of the water spreaders 107, beyond plan transition points 111 to lower sharp edges 81, tends to prevent any elements of water from reaching the upper flat surfaces of the skis 35, 37 and 39 which extend aftwardly from the elevational transition points 105 to the stern 21 area of the ski-toon boat 11, thus reducing drag and enhancing efficiency of traverse of the ski-toon boat 11 through the water. Further, because of this feature, any tendency of water to curl up over the sharp edges 81 of skis 35, 37 and 39, onto the top surfaces of those skis (which, aft of elevational transition points 105 extend outwardly from hulls 29, 31 and 33, respectively) just aft of elevational transition points 105, is virtually eliminated, thus essentially eliminating a potential cause of any tendency of the ski-toon boat 11 to dive or porpoise.

In regard to the outer skis 37 and 39, optionally lip extensions 109 can be added to the forward upwardly curved section of those skis 37 and 39, preferably only to the outer edges thereof and without addition of such to the inner edges thereof, although the addition of lip extensions 109 are not deemed necessary in the preferred embodiment of the ski-toon boat 11 as described herein. The lip extensions are canted upwardly at an angle, preferably a 45° angle, as best illustrated in FIG. 10. Lip extensions 109 serve to further divert any residual remaining bow wave spray outwardly and away from the ski-toon boat 11, further ensuring that spray does not enter the cockpit 79. The addition of lip extension 109 aid in eliminating spray especially when the ski-toon boat 11 is turning while on plane. The preferred 45° cant of the lip extensions 109 appears to be the optimal angle for diverting residual water spray outwardly and away from the ski-toon boat 11, thus tending to prevent water from coming into contact with the outer exposed top surfaces of the flat portions of the skis 37 and 39, aft from the elevational transition points 105, thus avoiding unnecessary drag and any tendency of dynamic water pressure forcing those outer skis 37 and 39 to dive into the water surface, thereby reducing the velocity of the ski-toon boat 11.

There is an additional surprising and unexpected benefit from incorporation of the water spreaders 107 into the ski-toon boat 11. Virtually all buffeting, porpoising and pitching of the ski-toon boat 11 is eliminated in rough water, heavy seas and wakes from other boats, whereby waves are encountered up to about the height of the bow 19 or somewhat greater. This phenomenum is not clearly understood, however, it is believed that, because the water spreaders 107 are open on the bottom, air may be trapped within the chambers formed by the interior sides of the water spreaders 107, the adjacent bottom surfaces of the respective skis, 35, 37 and 39, and the water surface. Those so formed air pockets, with air trapped therein, through compression and expansion caused by the rise and fall of the oncoming waves, may act as shock absorbers in respect to smoothing out the otherwise expected buffeting, porpoising and pitching which most conventional boats encounter when advancing through rough waters, heavy seas or wakes from other boats.

It is believed that substantial elimination of horizontal surfaces from the elevational transition points 105 to the bow points 103 of the skis 35, 37 and 39 serves to essentially eliminate forward spray from bow wave phenomenum. Such forward spray is generated by the conventional upwardly curved forward sections of conventional water skis as such skis traverse forward through bow waves. It is further believed that the concept of elimination of horizontal surfaces could be readily incorporated into conventional water skis to reduce or eliminate forward spray which serves to obscure the vision of water skiers, thus significantly increasing the safety of engaging in such sport.

Observations have indicated that variation of the amount of downward extension of the water spreaders 107, beneath the plane of the flat surface of the skis 35, 37 and 39, tends to somewhat alter the degree of buffet, porpoise and pitch reduction produced by incorporation of the water spreaders 107. It is believed that to function most efficiently and optimally, it may be necessary for the bottom edge of the water spreaders to be slightly lifted just above the water surface, so as to drain water and replace it with air; this of course happens repeatedly, very rapidly, but with rather minuscule reciprocation as the irregular surface of the water passes under and around the water spreaders 107. As the lower edge of the water spreaders 107 then re-enter the water, the air is momentarily compressed and forced reward to be expelled at about the elevational transition points 105 of the ski 35, 37 and 39. This compression and flow of air rearward are believed to produce the "shock absorber" effect described above.

If the extent of downward extension of the bottom edges of the water spreaders 107, beneath the plane of the bottom surface of the skis 35, 37 and 39, is too great, the frequency of separation from and reentry into the water decreases and the "shock absorber" effect seems to be correspondingly decreased. Likewise, if the extent of downward extension, of the bottom edges of the water spreaders 107, does not extend to the plane of the bottom surface of the skis 35, 37 and 39, the frequency of separation from and reentry into the water also is, apparently, decreased and the "shock absorber" effect seems to be, likewise, correspondingly decreased.

It appears that the "shock absorber" effect is substantially optimized when the downward extension of the bottom edges of the water spreaders 107 is about aligned with the plane of the bottom surface of the skis 35, 37 and 39, for the preferred embodiment of the ski-toon boat 11 as described herein, and no greater than about ½" below the plane of the bottom surface of the skis 35, 37 and 39, where the ski-toon boat is usually used in relatively rough waters. Thus, the parameters described above regarding optimization of the downward extension of the bottom edge of the water spreaders 107 appear to be equally applicable to optimization of the "shock absorber" effect.

Use of the water spreaders 107 produces yet another desirable result. In conventional water ski design, there is a tendency for the skis to ride up and over oncoming bow waves, creating pitching, i.e., an aft to stern rocking of the skis. The water spreaders 107, on the other hand, in combination with the prow 45 design of the ski-toon boat 11 as described herein, cause the skis 35, 37 and 39 to literally knife through bow waves, substantially eliminating pitching of the ski-toon boat 11, even with bow waves which are equivalent in height to the bow 19 or somewhat greater.

Figure 13:
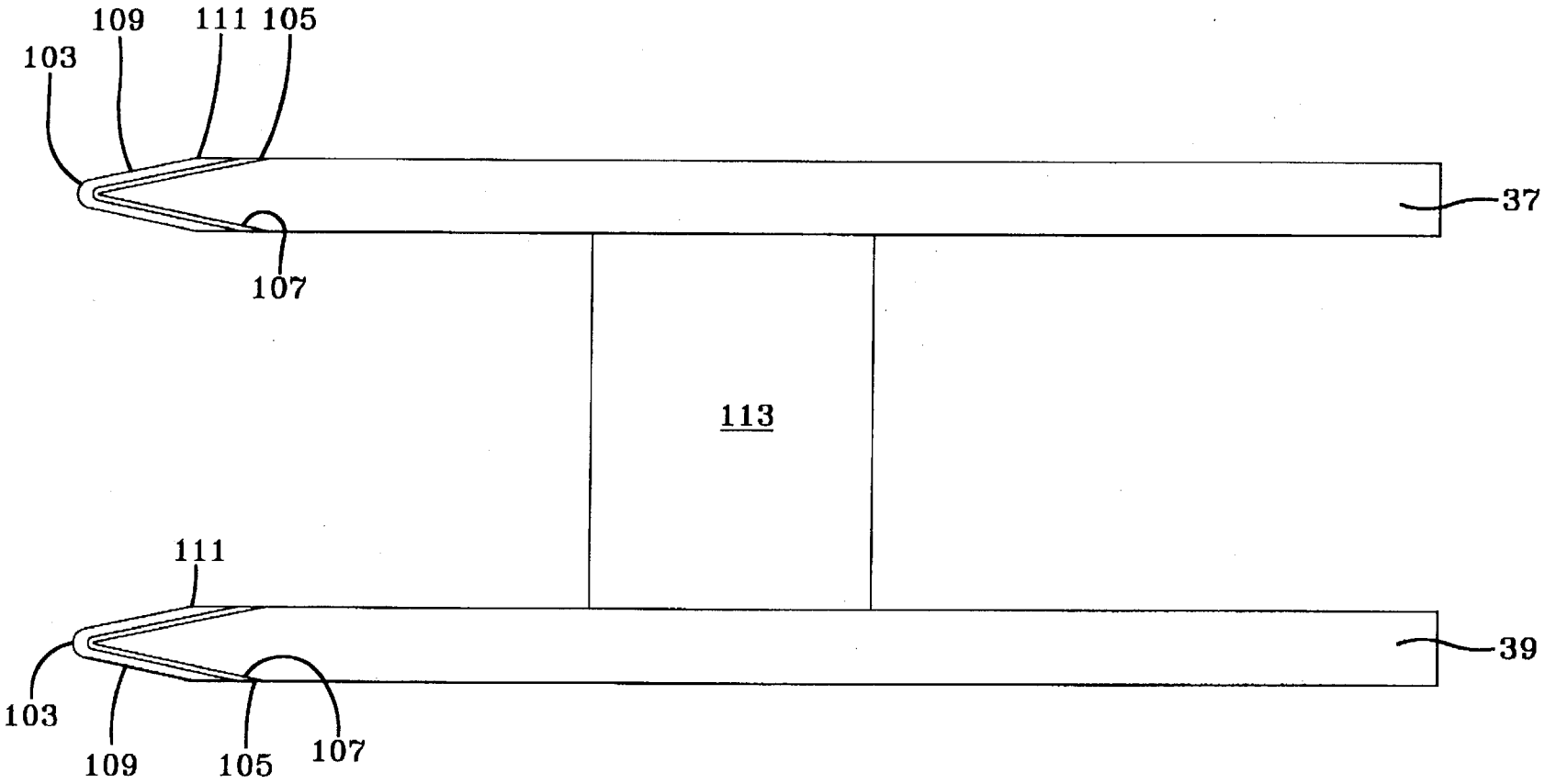
FIG. 13 is a semi-schematic contra-plan view of an alternate embodiment of the present invention as viewed looking straight up from beneath the skis.

It is noted that the foregoing arrangement of the skis 35, 37 and 39, which comprise ski platform assembly 15, is not limited to use in the ski-toon boat 11. Rather, the general arrangement of ski platform assembly 15, as described herein, but without inclusion of center ski 35, could readily be adapted to the pontoons of a ski plane, in substantially the same manner that outer skis 37 and 39 are mounted to outer hulls 31 and 33, respectively. Further, it is noted that outer skis 37 and 39, as described herein, could readily be adapted and used with conventional foot attachments, to be used by humans in the sport of water skiing. In both cases, the features produced by use of ski designs equivalent to those of skis 37 and 39, as described herein, would provide equivalent benefits to, respectively, ski planes and humans, as the case might be. Referring to FIG. 13, the foregoing alternate embodiment, utilizing two skis 37 and 39 is shown, with center ski 35 being eliminated. The skis 37 and 39 shown in FIG. 13 are mounted to an object 113 which could comprise hulls 31 and 33, as shown in various of the other drawing figures, or object 113 could represent the pontoon assembly of a sea plane, or object 113 could also represent a human being; the point is that object 113 could be virtually any body which is to be motivated through and upon the surface of a body of water. In all respects, however, skis 37 and 39, as depicted in FIG. 13, are generally equivalent to skis 37 and 39 as shown in drawing FIGS. 1 through 12, except that use of prow shield 101 is optional, depending on the species of object 113 to which skis 37 and 39 of FIG. 13 are to be mounted.

The basic frame of the preferred embodiment of the ski-toon boat 11 is a hollow core aluminum sandwich referred to herein as the core frame 41. Referring to FIG. 2, laterally positioned cross stringers 47 are welded between two sheets of aluminum, those being the floor plate 49 and the bottom plate 51. Floor plate 49 is preferably aluminum tread plate, as the upper surface of floor plate 49 is utilized as part of the floor of the cockpit of the ski-toon boat 11, as will be explained hereinafter. The sides of the core frame 41 are then welded closed with aluminum strips 59 as shown in FIG. 5.

The core frame 41 includes a break 53 at about the longitudinal mid-point, with the forward section 55 being tilted upwardly at an angle from the rear section 57. In the preferred embodiment, the forward most point of the forward section 55 of the core frame 41, i.e., the bow 19, is elevated three (3) feet above the level plane of the rear section 57. Additional strength and water piercing capability (when the ski-toon boat is cruising) is obtained by having a break 53 (to form an upwardly extending angle) in the core frame 41 so that the exposed surface to the on-coming waves has a wedge action that prevents the bottom plate 51 forward section 55 of the core frame 41 from pounding the oncoming waves, at cruising speeds. This same definite sharp bend angle or break 53 near the center of the boat, supported by the hulls 29, 31 and 33 and the gunwale assembly 17, prevents any twist stressing action which otherwise might be caused by "rolling" waves that strike the ski-toon boat 11. Additional wave cutting (piercing) action is obtained by having the height of the bow 19, i.e., the forward most extending point of the core frame 41, in relation to the height of the rear section 57 of the core frame 41, sufficient to accommodate the height of the oncoming wave. For example, if the average height of the waves to be penetrated is 3 feet, the height of the bow 19 should preferably be a minimum of 3 feet.

In the preferred embodiment, the bottom plate 51 of the core frame 41 is ⅛" thick (11 gauge) aluminum sheets, although the thickness of the aluminum sheets or plates used could be varied, depending on strength and weight considerations as are well known to those skilled in boat design and fabrication. In the preferred embodiment of the ski-toon boat 11, the aluminum cross stringers 47, which are ⅛"×2"×3" aluminum angles are welded to the aluminum bottom plate 51 of the core frame 41 with the 2" legs being abutted to the bottom plate 51 and the 3" legs extending upwardly. The aluminum floor plate 49 is 3/16" (7 gauge) welded to the upper edge of the 3" leg of the cross stringers 47 through punched slots cut for stitch welding the preferred aluminum non-slip diamond pattern (tread plate) floor plate 49. Alternatively, using virtually any type of metal, the floor plate 49, which becomes part of the ski-toon boat 11 cockpit floor, can be welded, bolted, screwed, riveted, or fastened with an appropriate adhesive to the cross stringers 47, which likewise could be any metal, in order to make a rigid core frame 41 for the hull assembly 13. In the preferred embodiment, the aluminum strips 59, welded to the floor plate 49 and the bottom plate 51, tend to further enhance the rigidity of the core frame 41.

In the preferred embodiment each of the three hulls 29, 31 and 33 is fabricated from two sides, those being sides 61 and 63 for center hull 29, sides 65 and 67 for outer hull 31, and sides 69 and 71 for outer hull 33. The sides 61, 63, 65, 67, 69 and 71 are mounted to and welded to the bottom plate 51 of the core frame 41. Sides 61 and 63 are mirror images of each other. Sides 65 and 71 are mirror images of each other. Sides 67 and 69 are mirror images of each other. The hull sides 61, 63, 65, 67, 69 and 71, mounted beneath the core frame 41, like the bottom plate 51, are ⅛" thick (11 gauge) aluminum sheets, although the thickness of the aluminum sheets or plates used could likewise be varied, depending on strength and weight considerations as are well know to those skilled in boat design and fabrication. The desired curvatures of each hull side 61, 63, 65, 67, 69 and 71 were developed applying standard principles of hydrodynamic and aerodynamic flow optimization, as are well known to those with skill in the field of boat hull design, e.g., marine architects. Likewise, the prow shields 101 are fabricated from ⅛" (11 gauge) aluminum and were developed applying lofting techniques as are well know to marine architects.

Figure 11:
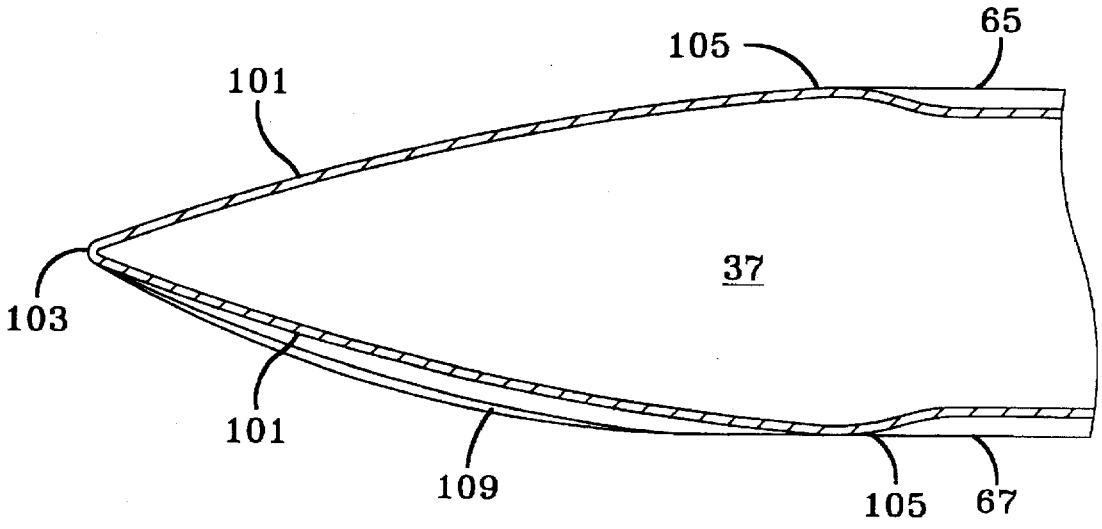
FIG. 11 is a partial, cut-away, semi-schematic plan view of an alternative embodiment of an outer hull portion of the ski-toon boat, similar in view to the outer hull portion shown in FIG. 9, illustrating enhanced spray reduction features.

In the alternative embodiment shown in FIG. 11, the prow shields 101 form and integral part of the hulls 29, 31 and 33, with the prow shields 101 extending aft from bow points 103 to points which is about ½" to 1" aft of elevational transition points 105, where the prow shields 101 are hydrodynamically mated to the hull sides 65, 67, 69 and 71, respectively, about as illustrated in FIG. 11.

The bottoms of the hulls 29, 31 and 33 are capped with skis 35, 37 and 39 respectively. In the preferred embodiment of the ski-toon boat 11, the skis 35, 37 and 39 are 3/16" thick (7 gauge) aluminum sheets welded in place, however, this thickness could be varied, depending on strength and weight considerations as are well know to those skilled in boat design and fabrication. Likewise, the water spreaders are 3/16" (7 gauge) aluminum sheets welded to the bottoms of the skis as explained above, however, this thickness could likewise be varied, depending on strength and weight considerations as are well know to those skilled in boat design and fabrication. In the preferred embodiment, the skis 35, 37 and 39 and the water separators 107 are greater in thickness, in comparison to the metal thickness used for the hulls 29, 31, and 33 and the core frame 41 to concentrate a greater mass at the lower points of the ski-toon boat 11, thus tending to lower the overall center of gravity thereof. Further, greater thickness of the skis 35, 37 and 39, and the water separators 107, in relation to the sheet or plate thickness of the hull sides 61, 63, 65, 67, 69 and 71 and the prow shields 101, and of the floor plate 49 and bottom plate 51 of the core frame 41, provides increased rigidity for strength and wear resistance when the skis 35, 37 and 39 and/or water spreaders 107 come into contact with or are scraped on or along the bottom, or when the ski 35, 37 and 39 and/or water spreaders 107 impact objects on the bottom such as rocks and tree stumps, all rather common occurrences in the course of navigating shallow bodies of water or near shore lines.

The preferred embodiment of the hull assembly 13 is 19 feet long and 8 feet 4" wide, having a width-to-length ratio of 1:2.28. It has been determined that a range of width-to-length ratios, from about 1:2 through about 1:2.5 functions acceptably within the parameters of the ski-toon boat 11 design. If the width-to-length ratio is less than about 1:2, a lesser degree of roll stability will result. If the width-to-length ratio is greater than about 1:2.5, the maneuverability of the watercraft tends to decrease slightly.

The outer skis 37 and 39, i.e., those which are adjacent to the longitudinal sides of the ski-toon boat 11, are preferably 19 feet long, matching the length of the preferred embodiment of the hull assembly 13, and 12" wide. The parameters for outer ski 37 and 39 length design are that the skis should not be so long as to extend beyond the substantial support of the hulls 31 and 33, respectively, attached to those skis 37 and 39, which serve to support those skis 37 and 39 and keep them rigid, and not so long as to exceed the maximum length of the preferred width-to-length ratio of the hull assembly 13, that being 1:2.5 in the preferred embodiment, (for the same reason, above, that the hull assembly 13 preferred maximum width-to-length ratio should preferably not be exceeded), and not so short as to be less than the minimum length of the preferred width-to-length ratio for the hull assembly 13, that being 1:2 in the preferred embodiment, (for the same reason, above, that the hull assembly 13 preferred minimum width-to-length ratio should preferably not be exceeded).

As mentioned above, the width of the outer skis 37 and 39 in the preferred embodiment is 12", an outer ski 37 and 39 width-to-length ratio of 1:19, although it has been determined that an outer ski 37 and 39 width-to-length ratio in the range of from about 1:18 through about 1:20 is quite acceptable as a design parameter for the outer skis 37 and 39 of the ski-toon boat 11. Outer skis 37 and 39 which have a width-to-length ratio of much less than 1:18 tend to reduce maneuverability of the ski-toon boat 11, that reduced maneuverability which is accentuated at slower velocities, while outer skis 37 and 39 which have a width-to-length ratio of much greater than 1:20 tend to cause the ski-toon to have an increased hull surface contact with the water, while planing, thus reducing the speed and fuel efficiency of the preferred embodiment of the ski-toon boat 11 design.

The center ski 35, in the preferred embodiment of the ski-toon 11, is 16 feet long and 18" wide. The forward or bow 19 positioning of the forward most point of the center ski 35, in the preferred embodiment, is slightly forward, by about 3", of the position of the forward most points of the outer skis 37 and 39, both of which are generally equivalent in position of their respective forward most points. The forward most point of the center ski 35 serves to form the central point of the bow 19 of the ski-toon boat 11. The advanced (by about 3") prow 45 of the center ski 35, during operation, allows for a slightly increased lateral hydraulic pressure on the center hull 29 prow 45 of the hull assembly 13, thus aiding in maneuverability of the ski-toon boat 11. The ratio of prow 45 advance, of the center ski 35, to the overall width of the hull assembly 13 is about 1:33.33 in the preferred embodiment. It has been determined that this ratio can range from about 1:30 through about 1:35 in the preferred embodiment of the ski-toon boat 11, although it has been determined that a ratio of much greater than 1:35 tends to slightly decrease speed and fuel efficiency, while a ratio of much less than 1:30 is indicative of slightly less maneuverability, although not at all a critical decrease in maneuverability. In fact, within the scope of the present invention, it is quite acceptable to have no prow 45 advance whatsoever, and still achieve quite acceptable, but less than optimum, maneuverability.

The stern 21 end of the center ski 35 is truncated, in the preferred embodiment of the ski-toon boat 11, by about 3' in comparison to the length of the outer skis 37 and 39, to allow for the positioning of a drive/steering system, i.e., a propeller or other drive mechanism and a rudder or other steering mechanism at the center of the stern 21 part of the ski-toon boat 11, but forward of the rear most ends of the outer skis 37 and 39. For example, the rudder/drive extension of an outboard motor, or an inboard/outboard motor, could be utilized as a combination steering mechanism and drive mechanism, i.e., as a drive/steering system. Thus, in effect, the rearward extensions of the outer skis 37 and 39 beyond the drive/steering system tend to significantly facilitate the lower speed planing of the ski-toon boat 11 and produce a more level running posture of the ski-toon boat 11 at cruising speed when it is up on a plane. Further, the rearward extensions of the outer skis 37 and 39 beyond the drive/steering system also tend to dampen pitching oscillation, or "porpoising" (as it is known to those skilled in the art). At cruise speed, when the ski-toon boat 11 is up on plane, only approximately the rear halves (or less) of the skis 35, 37 and 39 are generally in contact with the water. The degree to which the center ski 35 is truncated is dictated by the location of the drive/steering system in relation to the stern 21 section of the ski-toon boat 11, as will readily understood by those with skill in the art.

As mentioned above, the center ski 35 in the preferred embodiment of the ski-toon boat 11 is 18" wide. Thus, the ratio of center ski 35 width to length is about 1:10.67. It has been determined, however, that a width-to-length ratio in the range of from about 1:10.25 through about 1:11 operates satisfactorily with the ski-toon boat 11 for the center ski 35. If the center ski 35 width-to-length ratio is less than 1:10.25, the top speed and fuel efficiency are both slightly decreased. If the center ski 35 width-to-length ratio is much greater than about 1:11, maneuverability begins to suffer slightly.

In the preferred embodiment, a pair of strakes 73 and 75, each about ¼" in thickness, are positioned parallel to the length of the center ski 35, one each being welded to the center ski 35 respectively along each of the outer edges of that center ski 35, each strake 73 and 75 extending forward from the rear most end of the center ski 35 for a distance of about 6 feet. Each strake 73 and 75 extends perpendicularly downwardly, preferably about 2", from the generally horizontal plane of the center ski 35. The pair of strakes 73 and 75 act as vertically extending fins and, thus, aid in steering performance and tend to prevent sideways skidding of the ski-toon boat 11 at cruise speeds, up on plane. Preferably, the strakes do not extend, from the rear most end of the center ski 35, more than one-half of the length of the center ski, as it has been found that extensions of more than that length tend to raise to velocity at which the ski-toon boat 11 must be travelling to get up on plane.

For the preferred embodiment of the ski-toon boat 11, the empty weight is 2400 lbs. and the gross weight rating, including all loads, was determined to be rated at 4400 lbs. The gross weight rating was determined by loading the preferred embodiment of the ski-toon boat 11 with various loads and measuring the increase in draft associated therewith, as well as testing the maneuverability, top speed and fuel efficiency. It was determined that, although the amount of the load could significantly exceed the 2000 lbs. difference between the gross weight rating and the empty weight, still with quite acceptable maneuverability, the top speed was decreased appreciably as was the fuel efficiency. Thus, the key determining factors for determining gross weight rating were speed and fuel efficiency under load, followed by net load weight. surprisingly, unlike with conventional hulled boats, it was found that load placement had relatively little effect on the performance of the ski-toon boat 11. For differing given weights of loads, from about 200 lbs. to about 1,800 lbs., load centers were varied, within the cockpit from side to side and/or from forward to aft, with little significant change in performance for a given load.

Standard lofting procedures, as are well known to those skilled in the art of boat hull design and fabrication, are used to develop the shapes of the hull side 61, 63, 65, 67, 69 and 71 as well as the prow shields 101.

Lofting comprises the process of establishing the shape of a boat hull. For the preferred embodiment of the ski-toon boat 11 hull assembly 13, this was accomplished by the following method:

1. A wood and aluminum angle frame was built on the shop floor. This frame was shimmed to be level and perfectly flat. This frame was of the same overall dimensions, i.e., 19' long by 8' 4" wide for the preferred embodiment of the ski-toon boat 11 hull assembly 13.
2. A scale side elevational view drawing is then made of the desired shape of each of the hull sides 61, 63, 65, 67, 69 and 71. The desired curvatures of each hull side 61, 63, 65, 67, 69 and 71 was developed applying standard principles of hydrodynamic and aerodynamic flow optimization, as are well known to those with skill in the field of boat hull design, e.g., marine architects.
3. On the side elevational drawings of each hull 29, 31 and 33, vertical lines were laid out to scale such that, in full scale, those vertical lines would be spaced one foot apart, so as to divide the hull side 61, 63, 65, 67, 69 and 71 views in equal segments, front to back. In this manner, corresponding reference points were incrementally established at the top and bottom of each hull side 61, 63, 65, 67, 69 and 71, along the full length of each of those hull sides, front to back, thus establishing discrete vertical distances therebetween.
4. Then a plan view drawing of each hull 29, 31 and 33 was made, corresponding in scale to the side elevational view drawings made above. On each of these plan view drawings, horizontal reference lines were laid out, likewise spaced one foot apart, corresponding to those vertical lines laid out, as explained above, on the side elevational view drawings. In this manner, corresponding reference points were incrementally established on each of the hull sides 61, 63, 65, 67, 69 and 71, along the full length of each hull 29, 31 and 33, front to back, thus establishing discrete horizontal distances therebetween.
5. Once the incremental corresponding vertical and horizontal dimensions were established, front to back, for each hull side 61, 63, 65, 67, 69 and 71, at one foot intervals, then, by application of the Pythagorean theorem, the length of the hypotenuse of each triangle was established, thus giving the actual cross planar distances on each of those hull sides, at one foot intervals front to back along the full length of each of those hull sides. These hypotenuse distances were then used to develop shop fabrication drawings for the cut out of each hull side 61, 63, 65, 67, 69 and 71 from the ⅛" (11 gauge) aluminum plate. Similar procedures were used to develop the prow shields 101 as will be readily understood by those skilled in the art.
6. Once the hull sides 61, 63, 65, 67, 69 and 71 were laid out on the aluminum plates and cut out, they were fitted to the skis 35, 37 and 39 and to the core frame 41. This was done by setting the skis 35, 37 and 39 into the wood and aluminum angle frame, built on the shop floor, and then positioning and bracing the hull sides 61, 63, 65, 67, 69 and 71 in relation to those skis, at the desired angles and curvatures, then positioning the core frame 41 on top of those hull sides. Minor trimming and shop fitting was required on the hull sides 61, 63, 65, 67, 69 and 71 to mate them to the essentially flat (except for the upward curvature of the fronts of each ski) plane of the skis 35, 37 and 39, and for fitting those hull sides to the essentially flat planes of the core frame 41 longitudinally on either side of the break 53. Such minor trimming and fitting are well known to, and part of the expected, normal and usual experience of those with normal skill in the field of boat fabrication. Similar trimming and fitting was required to fit the prow shields 101 to the skis 37 and 39 and the hull sides 65, 67, 69 and 71, as will be readily understood by those with skill in the art.

The gunwale assembly 17 of the ski-toon boat 11, mounted to the core frame 41 and extending upwardly therefrom, longitudinally starts at the approximate height of the bow 19 and extends back to the transom 77 at a slight downward angle to form an adequate water spray barrier. As shown in FIGS. 1 and 5, transom 77, from bottom to top, is preferably canted aftwardly to diminish the entry of spray, emanating from around the drive mechanism area, into the cockpit 79 at the stern 21 of the ski-toon boat 11, but optionally, transom 77 may be positioned generally vertically as shown in FIG. 2 for drive mechanism clearance, if necessary. The gunwale assembly 13 upper edge is formed by a round pipe, slit lengthwise, and welded to the sheet sides for strength and form the side rail assembly 25. The sides of the ski-toon boat 11 gunwale assembly 17, above the core frame 41, are canted inwardly, from bottom to top, toward the center of the ski-toon boat 11, so that a person boarding that boat can first step on the bumper rail assembly 27 outside of those sides upon entering or leaving the ski-toon boat 11. A round pipe is welded to the entire outside top edge of the core frame 41, forming the bumper rail assembly, so as to act as a dock bumper, for stiffening and reinforcing, and to afford a step to prevent a person's foot from slipping off the gunwale assembly 17. The gunwale assembly forms the outer periphery of the cockpit 79.

The center hull has a cut out in the core frame to make a relatively recessed well 80 beneath the cockpit 79, for the pilot of the craft to stand on the hull bottom, i.e., on the upper surface of the center ski 35, and to optionally hold a fuel tank (not shown) in the middle of the craft. The recessed well 80 beneath the cockpit 79 lowers the center of gravity of the pilot when standing. The outer two hulls 31 and 33 of the ski-toon are sealed and thus become flotation chambers.

In the preferred embodiment, the center ski 29 is cut off short of the transom 77 so that the single engine propelling the boat can be mounted higher on the boat and thereby raising the propeller higher in relation to the very bottom surfaces of the ski-toon boat 11 and affording greater propeller clearance from under water objects. The center hull 29 beneath the transom 77 is tapered forwardly and downwardly to meet the truncated rear of the center ski 35 as best shown in FIGS. 1, 5 and 6. The outer hulls 31 and 33 extend aftwardly beyond the transom 77 and give pitching stability to the ski-toon boat 11 to curb porpoising at various speeds depending on boat loading and fore and aft balancing of cargo.

The hull sides 61, 63, 65, 67, 69 and 71 make a very slender and gradual transition from pointed prow 45, or prow shields 101, as the case may be, to the full width of each hull 29, 31 and 33, all the way back to the break 53 in the core frame 41. This affords a sharp knifing of the prows 45, or the prow shields 101, as the case may be, through the water, and thereby prevents pounding and slapping of the hull assembly 13, including the core frame 41, against the oncoming waves at cruise speeds. This knifing also dissipates any offset rolling action that makes the overall hull assembly 13 less susceptible to rolling and capsizing. A wave impact on only one outer ski 37 or 39 and/or outer hull 31 or 33, respectively, is less likely to force the ski-toon boat 11 to roll over when that ski and/or hull cuts through rather than riding up and over a wave. The rear ends of the hulls 29, 31 and 33 ride high enough above the water to afford ample clearance for passage of the resulting semi-spent waves as they reach the core frame 41 break 53 and move aft therefrom.

Because of its basic design and configuration the ski-toon boat 11 rides high on top of the water, even at slow cruise velocities, with a wake that's only inches deep as opposed to a deep V-hulled boat which cuts a relatively deep swath in the water. Plowing through the water, a deep V-hulled boat becomes a fuel hog; the ski-toon boat 11, on the other hand, is fuel efficient and is a high speed boat for it's horsepower.

A single V-bottom boat strikes oncoming waves like a battering ram, as opposed to the multiple (serrated) front edge of the prows 45 and prow shields 101 of the ski-toon boat 11, those prows 45 and prow shields 101 which slice through the water. Forward movement of a single V-bottom boat tends to cause the water to form a bow wave which, in effect is an irregular wall of water against which the boat must push; the bow wave slaps and pounds the boat and jars the passengers, and tends to place exaggerated stress on the seams. The ski-toon boat 11, however, with the surprising anti-buffeting and anti-pitch features produced by the incorporation of the water spreaders 107, glides smoothly through waves up to the height of the bow 19, and to a somewhat greater wave height, with a very gentle sideways rocking motion and with essentially no pounding and slapping.

The design of the ski-toon boat 11 can be built with any of the methods now used for boat construction, e.g., welding, screwing, bolting, riveting, gluing or FRP lay-up. In addition to aluminum, the materials used may be sheet steel (stainless or non stainless), composite construction, FRP or other plastics, wood or plywood, or any combination of the foregoing.

Care should be taken to maintain sharp ski surface edges 81 on the flat surfaces (aft of elevational transition points 105) of the skis so that drag can be minimized where the ski edges, but not the hull sides, contact the water. In other words, referring to FIGS. 3 and 4, it will be noted that the skis 35, 37 and 39 extend laterally beyond the lowest points of the hull sides 61, 63, 65, 67, 69 and 71, where those hull sides adjoin the skis. Thus, when the hull assembly 13 moves forward from static up to plane, there is less water drag on the hulls 29, 31 and 33 at the point where the hull assembly 13 achieves a plane, thus substantially aiding in the ability of the hull assembly 13 to readily pop up on top of the water at a significantly lower velocity in comparison to conventional v-hulled boats.

The ski-toon boat 11 configuration lends itself to a relatively large, usable inside floor area for storage and passengers. In conventional, v-hulled boats, objects in transit must be stored so that if they are delicate, they (including passengers) must be in the rear of the boat, due to wave pounding on the bow; if they must be dry, they must be stored forward. In contrast, objects can be stored in any and all areas of the ski-toon boat 11. Generally the pilot of a conventional boat positions him or herself relatively toward the rear of the boat, to avoid pounding and to enhance the planing capability of the v-hulled boat. On the other hand, the helm of the ski-toon boat 11 is right up front on the dashboard 43 for excellent visibility, without any detraction produced by the planing of the ski-toon boat 11, and without the bow wave pounding and slapping that is characteristic of v-hulled boats.

The procedure for fabricating the preferred embodiment of the ski-toon boat 11 is as follows:

1. Overall length, width, depth and general configuration (number of hulls) is determined. In the preferred embodiment, it was initially determined that the ski-toon boat 11 would be designed for use in waters which did not often encounter waves of greater than about 3' at cruising speeds (with the ski-toon boat 11 up on plane) without reducing speed. From this 3' wave parameter, it was determined that a hull assembly 13 of the dimensions stated above would be generally acceptable, using established parameters well known to those skilled in the art of boat design. From those dimensions, the material weights were determined for the fabrication of the ski-toon boat 11 using the materials as stated above. Then, applying well known principals of physics and mechanical engineering, the center of gravity was determined for the ski-toon boat 11, matching the dimensions stated above and using the materials stated above. Utilizing that same center of gravity, weight and dimensions, and applying well known principals of boat design and engineering, the static draft of the ski-toon boat 11 empty, on average, was determined to be about 9", with the total height of the hulls 29, 31 and 33 beneath the core box at the rear being about 18".
2. The 3' height of the bow 19 was determined to accommodate approximately a 3' wind wave or wake from another boat.
3. Aluminum sheet thickness for the hull sides 61, 63, 65, 67, 69 and 71 is selected on the basis of overall strength required, and on how thick the sheets must be to become easily and quickly welded. As explained above, ⅛" (11 gauge) thickness is selected because it can be easily and quickly welded, despite the fact that 0.100" thickness would have been adequate for strength, as is conventionally used by boat builders for boats of the relative similar size to the ski-toon boat 11.
4. For extra strength at the very bottom of the hulls, as stated above, 3/16" (7 gauge) thickness aluminum sheet is used to form the skis 35, 37 and 36 and the water spreaders 107 for the reasons explained above.

5. These skis 35, 37 and 39 are sized on the basis of 70 pounds of overall gross weight of boat per square foot of flat surface area exposed to the water, at cruise speed, i.e., at planing speed, estimated to be attainable between 10 and 15 mph based on, and extrapolated from, calculations of square footage loads on conventional water skis used by humans and the observed speed at which planing is attained by humans using those water skis.

6. The skis 35, 37 and 39 are cut to size first. The outer skis 37 and 39 are formed from 3/16" (7 gauge) aluminum plate cut to a rectangular size 19' long by 12" wide, while the center ski 35 is formed of a 3/16 (7 gauge) aluminum plate cut to a rectangular size of 16' long by 18" wide. As best shown in FIG. 6, one end, the forward end of each of the outer skis 37 and 39 is rounded off to a radius which is equal to ½ of the width of the ski. An equivalent radius is formed onto the forward end of the center ski 35, and a transition section is used to taper the radius to the 18" width of the center ski 35, as shown in FIG. 6. As welded in place, the front, rounded end of each ski is bent upwardly from the horizontal about 4" to form a "sled runner" shape. The curvature of the upward bend of the forward section of each ski is formed to match the curvature designed into the hulls 29, 31 and 33, as explained above. In forming the skis, each of the cut-to-size and front end tapered skis are laid in relative position on the flat and leveled pre-built fixture or jig on the floor of the shop, as explained above; that fixture incorporates the desired forward section upward curvature of the skis. Temporary strips are tack welded to hold each ski in place in the fixture at the stern 21 end of the skis 35, 37 and 39. The bow 19 end of the skis 35, 37 and 39 is left without anchoring so the bow 19 section of the skis 35, 37 and 39 can be flexed upwardly and welded to the hull sides 61, 63, 65, 67, 69 and 71 when those hull sides are positioned into the fixture.

7. The center ski 35 is made 50% wider than the outer skis 37 and 39. To ensure rigid support and strength for a cockpit 79 of ample size and width for the pilot of the craft, the center hull 29 hull walls 61 and 63 are tapered outwardly and upwardly from the center ski 35 so as to encompass an open space beneath the lateral center portion of the core frame 41, the width of that open space being about 50% of the width of the core frame 41. Access to that open space is through a cut out from and through the core frame 41, that cut out which is about 20" wide and laterally centered on the core frame 41. The floor plate 49 of the core frame 41 serves as both a structural member and as the floor or deck of the balance of the cockpit 79. The open area, cut out from and through the core frame 41, extends for the full length of the cockpit 79, from the dashboard 43 to the transom 77, thus enabling access to that area of the top of the center ski 35 which lies beneath the cockpit 79. In operating the ski-toon boat 11, the pilot stands on the exposed top of the center ski 35; a fuel tank may also be mounted thereon. The hull assembly 13 is centered to extend longitudinally along the bottom of that core frame 41. The width of the center hull is about 3' wide at the point of its attachment to the core frame 41 beneath the cockpit. From that point, the hull sides 61 and 63 extend downwardly, tapering inwardly at a about a 30° acute angle, on average, from vertical to meet the 18" width of the center ski 35.

8. The hull sides 61, 63, 65, 67, 69 and 71 and the prow shields 101 are lofted, as explained above, cut to size and shape, and welded in place on the skis.

9. Minor edge trimming of the top and bottom edges of the hull sides 61, 63, 65, 67, 69 and 71 is done to mate with the flat, ⅛" (11 gauge) thick aluminum surface of the core frame 41 bottom plate 51, and the top, 3/16" (7 gauge) aluminum surfaces of the skis 35, 37 and 39.

10. Hull ends 83, 85 and 87 are cut, likewise from ⅛" (11 gauge) aluminum plate, and fitted respectively to hulls 29, 31 and 33, then those hull ends 83, 85 and 87 are welded respectively to hull sides 61 and 63 and center ski 35, hull sides 65 and 67 and outer ski 37, and hull sides 69 and 71 and outer ski 39 so as to cap the stern 21 ends of hulls 29, 31 and 33 to make them water tight. The upper edges of hull ends 83, 85 and 87 are ultimately welded to the stern end of core frame 41, to both the floor plate 49 and the bottom plate 51 so as to cap the stern end of core frame 41 in order to seal that stern end. A similar piece is cut and fitted to form bulkhead 89 and welded in place to seal off the bow 19 portion of center hull 29 which extends forward from dashboard 43, so as to form a water tight chamber therein. Then the core frame 41 is positioned on the hulls 29, 31 and 33 and welded thereto in place so as to form a water tight seal.

11. A cutout is made through the core frame 41, over the center hull 29 to develop a recess extending downwardly from the core frame 41 to the top of the center ski 35. The cutout is centered side-to-side of the ski-toon boat 11, and it is about 20" wide. The cutout extends from the transom 77, at the rear of the boat to the dashboard 43.

12. 2"×3"×⅛" angles are welded crosswise to the fore and aft center line of the hull to form the cross stringers 47, on the top of the bottom plate 51 of the core frame 41 on 15" centers starting at 15" aft of the bow 19. The 2" legs of the angles are laid flat on top of the bottom plate 51, and the 3" legs are welded to the floor plate 49 of the core frame 41, through slots formed in that floor plate 49, as explained above. Cutouts (not shown) may be made through the 3" legs of these cross stringer 47 angles through which cables, hoses and/or control rods may be extended for steering, fuel lines, etc. The cross stringer 47 angles extend the full width of the interior of the ski-toon boat 11, except those which extend to the cut out of the core frame 41 which provides access to the top of the center ski 35 from the cockpit 79.

13. The floor plate 49 of the core frame 41 is cut and sized and fitted to match the bottom plate 51 of the core frame 41. This floor plate 49 is 3/16" thick (7 gauge), diamond stamped, non skid, aluminum, with slots cut to match the positioning of the 2"×3" cross stringer 47 angles so stitch welds, made from the upper surface of the floor plate 49 to the upper edge of the 3" vertical leg of the cross stinger 47 angles, can secure the floor plate 49 of the core frame 41 in place.

14. Edge strips 59, 3" wide and ⅛" thick (11 gauge) are cut and welded in place to the core frame 41 so as to cover the exposed ends of the 2"×3" cross stringer 47 angles and seal the core frame 41.

15. 1½" NPS schedule 40 aluminum pipe is welded around the sides of the craft to afford a bumper rail assembly 27, i.e., a dock bumper and step to aid in entering and leaving the ski-toon boat 11. The pipe is welded to the top surface of the floor plate 49 of the core frame 41 so as to provide a lip around the perimeter of floor plate 49 which extends outwardly 6" beyond the sides of the gunwale assembly 13, but does not extend beyond the transom 77. In fact, the bumper rail assembly 27 does not extend beyond the stern 21 end of the spray shield sides 91 and 93 where it is intersected on both sides of the ski-toon boat 11 by the side rail assembly 25 as best shown in FIGS. 1 and 4. The side rail assembly 25 does not extend fully across the transom 77, but rather is separated by a beefing strip 95, as shown in FIG. 4, the beefing strip 95 which forms a connection between the sections of side rail assembly 27 which extend onto the transom 77.

16. ⅛" (11 gauge) sheet spray shield sides 91 and 93 of the gunwale assembly 17, the dashboard 43 and the transom 77 are cut to size & shape and welded in place on the floor plate 49 and to each other at the corners. The spray shield sides 91 and 93 are positioned 6" in towards the longitudinal center line from the full width of the core frame 41 on each side and stitch welded in place to the floor plate 49.

17. To form the side rail assembly 25, 1¼" NPS schedule 40 aluminum pipe is slit lengthwise along one side, slipped over the uppermost edges of the spray shield sides 91 and 93 and stitch welded in place, after those spray shield sides are welded to the floor plate 49, to complete the gunwale assembly 13 of the ski-toon boat 11.

18. As indicated above, a ½"×3" aluminum beefing strip 95 is added (welded) to the center portion of the edge of the transom 77 to stiffen the mounting for an outboard motor (not shown) to be later bolted on.

19. A console 97 is fashioned to mount the helm (not shown) near the front of the center hull 29, the console being incorporated as part of the dash board 43. The dash board 43 spans the front of the cockpit 79 of the ski-toon boat 11 and wraps around the total cockpit 79, including the inner faces of the spray shield sides 91 and 93. There is no front deck, or cowl, which extends from the dashboard to the actual bow 19. Rather, the forward most portion of the forward section 55 of the floor plate 49, together with the forward most portions of the upwardly extending spray shield sides 91 and 93 for a well to comfortably accommodate a crew member standing therein to asset in docking.

20. A main fuel tank (not shown) may be fabricated (34 gal. cap.) and installed in the center hull 29 rearward from the point at which the pilot stands at the helm.

21. Floor boards (not shown) may be added over the gas tank.

22. The gas tank compartment (not shown) may be ventilated (also not shown).

23. Sealed clean out covers (not shown) may be cut into and through the core frame 41 to afford access to the outer hulls 31 and 33 so as to maintain the sealed outer hulls 31 and 33 as floatation chambers.

The foregoing is a detailed description of the presently known best mode for accomplishing the present invention and the presently known most preferred embodiment of that invention. However, it is to be understood that the scope of the present invention is not limited to and/or by the foregoing, but rather is defined by the following claims.

What is claimed is:

1. In a ski-toon boat comprising:

A. a hull assembly, said hull assembly comprising a ski platform assembly, mounted to the bottom of said hull assembly;

B. a core frame to which the top of said hull assembly is mounted, said core frame extending longitudinally substantially from the bow end to the stern end of said ski-toon boat, said core frame extending laterally substantially from side to side of said ski-toon boat;

C. a gunwale assembly comprising:

(i) a pair of spray shield sides, mounted to said core frame and extending upwardly therefrom;

(ii) a side rail assembly, mounted to the top edges of said pair of spray shield sides;

(iii) a bumper rail assembly, mounted to and surrounding said mounting of said pair of said spray shield sides to said core frame; and (iv) a transom mounted to said core frame and extending upwardly therefrom, said transom also mounted to each of said pair of spray shield sides;

wherein said core frame, said pair of spray shield sides and said transom form a cockpit within said ski-toon boat;

wherein said hull assembly comprises:

A. a center hull mounted longitudinally beneath the longitudinal center line of said core frame, said center hull comprising a pair of center hull sides, said pair of center hull sides are formed into a center prow at the bow end of said ski-toon boat, said center hull including, at the stern end thereof, a center hull end, the top edges of said center hull being fixed to said core frame; and B. a pair of outer hulls, each of said pair of outer hulls being mounted adjacent to and beneath a side edge, respectively, of said core frame, each of said pair of outer hulls extending longitudinally substantially from bow to stern of said core frame, each of said pair of outer hulls comprising a pair of outer hull sides, each pair of said outer hull sides are formed into an outer prow at the bow end of said ski-toon boat, each of said pair of outer hulls including, at the stern ends thereof, an outer hull end, the top edges of each of said pair of outer hulls being fixed to said core frame;

a ski platform assembly comprising:

A. a center ski longitudinally mounted and fixed to the bottom edge of said center hull; and B. a pair of outer skis, each of said pair of outer skis being respectively longitudinally mounted and fixed to a bottom edge of each of said pair of outer hulls;

wherein the bottom edges of said center hull and the bottom edges of each of said pair of said outer hulls are curved upwardly at the bow ends thereof, wherein said center ski is curved upwardly at the bow end thereof to match said upward curvature of said bottom edge of said center hull, and wherein each of said pair of said outer skis is curved upwardly to match said upward curvatures respectively of said bottom edge of each of said pair of outer hulls;

C. a pair of strakes, each of which is mounted to the bottom of said center ski, each strake being fixed to said bottom of said centers ski at a position adjacent to the side edges of said center ski and extending downwardly therefrom, said pair of strakes extending longitudinally and parallel to each other from the stern end of said center ski toward the bow end of said center ski for a distance not exceeding one half the length of said center ski;

D. prow shield means extending upwardly and aftwardly, respectively, from said center ski and each of said pair of outer skis, said prow shield means which function to substantially prevent water from reaching upper surfaces of said upwardly curved bow ends of said center ski and each of said pair of outer skis, respectively; and E. water spreader means which function to separate and spread water which reaches the bow ends, respectively, of said center ski and each of said pair of outer skis, said water spreader means which are mounted to the lower surfaces of said upwardly curved bow ends of said center ski and each of said pair of outer skis.

2. The invention of claim 1 wherein said center hull and said center ski are truncated at a position forward of said transom and each of said pair of outer hulls and each of said pair of outer skis extends rearward from said transom of said ski-toon boat.

3. The invention of claim 1 wherein said prow shield means, in relation to each of said skis, comprises a prow shield positioned such that the upper edges of said upwardly curved bow ends of each of said skis is not exposed to oncoming water, each of said prow shields which respectively, substantially covers the prow end of each of said hulls.

4. The invention of claim 1 wherein said prow shield means, in relation to each of said skis, comprises a prow shield positioned such that the upper edges of said upwardly curved bow ends of each of said skis is not exposed to oncoming water, each of said prow shields forming a prow end, respectively, of each of said hulls.

5. The invention of claim 4 wherein each of said prow shields is, respectively, an integral part of each of said hulls.

6. The invention of claim 1 wherein each of said water spreader means comprises a water spreader which comprises a v-shaped structure comprising vertically flat surfaces and a sharp vertical edge where said vertically flat surfaces adjoin, each of said water spreaders, respectively, being mounted to the bottom surface of each of said upwardly curved bow ends of each of said skis, each of said so mounted water spreaders being positioned to extend vertically downwardly, respectively, from each of said upwardly curved bow ends of each of said skis, said sharp vertical edge of each of said water spreaders being positioned to extend vertically downwardly, respectively, from the bow point of each of said skis.

7. The invention of claim 6 wherein each of said water spreaders extends horizontally aftwardly, respectively, to a point on the bottom surface of each of said skis at which there is, respectively, a transition of said upwardly curved bow end of each ski to a flat bottom surface, said aftward extension of each of said water spreaders being terminated at sharp parallel edges, respectively, of each of said skis.

8. The invention of claim 6 wherein each of said water spreaders, respectively, is mounted horizontally inwardly from said sharp parallel edges of each of said skis.

9. The invention of claim 7 wherein each of said water spreaders, respectively, is mounted horizontally inwardly from said sharp edges of each of said skis.

10. A ski platform assembly, mounted and fixed to a hull assembly, said ski platform assembly comprising:

(i) a center ski longitudinally mounted and fixed to the bottom edge of said hull assembly; and (ii) a pair of outer skis, each of said pair of outer skis being respectively longitudinally mounted and fixed to said hull assembly;

wherein said center ski is curved upwardly at the bow end thereof, wherein each of said pair of said outer skis is curved upwardly, and wherein each of said skis has sharp, longitudinal parallel edges;

(iii) a pair of strakes, each of which is mounted to the bottom of said center ski, each strake being fixed to said bottom of said center ski at a position adjacent to the side edges of said center ski and extending downwardly therefrom, said pair of strakes extending longitudinally and parallel to each other from the stern end of said center ski toward the bow end of said center ski for a distance not exceeding one half the length of said center ski;

(iv) prow shield means extending upwardly and aftwardly, respectively, from said center ski and each of said pair of outer skis, said prow shield means which function to substantially prevent water from reaching upper surfaces of said upwardly curved bow ends of said center ski and each of said pair of outer skis, respectively; and (v) water spreader means which function to separate and spread water which reaches the bow ends, respectively, of said center ski and each of said pair of outer skis, said water spreader means which are mounted to the lower surfaces of said upwardly curved bow ends of said center ski and each of said pair of outer skis.

11. The invention of claim 10 wherein said prow shield means, in relation to each of said skis, comprises a prow shield positioned such that the upper edges of said upwardly curved bow ends of each of said skis is not exposed to oncoming water, each of said prow shields which, respectively, substantially covering a portion of the prow end of said hull.

12. The invention of claim 10 wherein said prow shield means, in relation to each of said skis, comprises a prow shield positioned such that the upper edges of said upwardly curved bow ends of each of said skis is not exposed to oncoming water, each of said prow shields forming a prow end, respectively, of a portion of said hull.

13. The invention of claim 12 wherein each of said prow shields is, respectively, an integral part of a portion of said hull.

14. The invention of claim 10 wherein each of said water spreader means comprises a water spreader which comprises a v-shaped structure comprising vertically flat surfaces and a sharp vertical edge where said vertically flat surfaces adjoin, each of said water spreaders, respectively, being mounted to the bottom surface of each of said upwardly curved bow ends of each of said skis, each of said so mounted water spreaders being positioned to extend vertically downwardly, respectively, from each of said upwardly curved bow ends of each of said skis, said sharp vertical edge of each of said water spreaders being positioned to extend vertically downwardly, respectively, from the bow point of each of said skis.

15. The invention of claim 14 wherein each of said water spreaders extends horizontally aftwardly, respectively, to a point on the bottom surface of each of said skis at which there is, respectively, a transition of said upwardly curved bow end of each ski to a flat bottom surface, said aftward extension of each of said water spreaders being terminated at the sharp parallel edges, respectively, of each of said skis.

16. The invention of claim 14 wherein each of said water spreaders, respectively, is mounted horizontally inwardly from said sharp, longitudinal edges of each of said skis.

17. The invention of claim 15 wherein each of said water spreaders, respectively, is mounted horizontally inwardly from said sharp, longitudinal edges of each of said skis.

18. A pair of skis, each of said pair of skis being respectively longitudinally mountable to an object to be moved through and over the surface of water, wherein each of said pair of said skis is curved upwardly at the bow end thereof, each of said pair of skis which comprises:

(i) prow shield means extending upwardly and aftwardly, respectively, from each of said pair of skis, said prow shield means which function to substantially prevent water from reaching the upper surface of said upwardly curved bow end of each of said pair of skis, respectively; and (ii) water spreader means which function to separate and spread water which reaches the bow ends, respectively, each of said pair of skis, said water spreader means which are mounted to the lower surface of said upwardly curved bow end of each of said pair of skis.

19. The invention of claim 18 wherein each of said water spreader means comprises a water spreader which comprises a v-shaped structure comprising vertically flat surfaces and a sharp vertical edge where said vertically flat surfaces adjoin, each of said water spreaders, respectively, being mounted to the bottom surface of each of said upwardly curved bow ends of each of said skis, each of said so mounted water spreaders being positioned to extend vertically downwardly, respectively, from each of said upwardly curved bow ends of each of said skis, said sharp vertical edge of each of said water spreaders being positioned to extend vertically downwardly, respectively, from the bow point of each of said skis.

20. The invention of claim 18 wherein each of said water spreaders extends horizontally aftwardly, respectively, to a point on the bottom surface of each of said skis at which there is, respectively, a transition of said upwardly curved bow end of each ski to a flat bottom surface, said aftward extension of each of said water spreaders being terminated at the sharp parallel edges, respectively, of each of said skis.

* * * * *